US010596844B2

(12) United States Patent
Kano

(10) Patent No.: US 10,596,844 B2
(45) Date of Patent: Mar. 24, 2020

(54) PRINTING APPARATUS

(71) Applicant: Brother Kogyo Kabushiki Kaisha, Nagoya-shi, Aichi-ken (JP)

(72) Inventor: Yasutoshi Kano, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 319 days.

(21) Appl. No.: 15/715,314

(22) Filed: Sep. 26, 2017

(65) Prior Publication Data

US 2018/0345706 A1 Dec. 6, 2018

(30) Foreign Application Priority Data

May 31, 2017 (JP) ..... 2017-108117

(51) Int. Cl.
*B41J 2/335* (2006.01)
*B41J 35/10* (2006.01)
(Continued)

(52) U.S. Cl.
CPC ..... *B41J 35/10* (2013.01); *B41J 2/325* (2013.01); *B41J 19/00* (2013.01); *B41J 19/005* (2013.01); *B41J 25/308* (2013.01); *B41J 25/3082* (2013.01); *B41J 25/3086* (2013.01); *B41J 25/3088* (2013.01); *B41J 25/312* (2013.01); *B41J 29/023* (2013.01); *B41J 33/14* (2013.01);
(Continued)

(58) Field of Classification Search
CPC ..... B41J 2/335
USPC ..... 400/229
See application file for complete search history.

(56) References Cited

U.S. PATENT DOCUMENTS 5,733,053 A * 3/1998 Sasaki ..... B41J 17/36 400/120.02
5,820,277 A * 10/1998 Schulte ..... B41J 2/325 400/223
(Continued)

FOREIGN PATENT DOCUMENTS

GB 2360739 A 10/2001
JP S61-66661 A 4/1986
(Continued)

OTHER PUBLICATIONS

Mar. 22, 2018—(EP) Extended Search Report—App 17193827.7.

*Primary Examiner* — Anthony H Nguyen
(74) *Attorney, Agent, or Firm* — Banner & Witcoff, Ltd.

(57) ABSTRACT

There is provided a printing apparatus, including: a base; a thermal head including heating elements arranged in a first direction; a first engagement member; a second engagement member configured to engage with the first engagement member such that the thermal head pivotally moves, relative to the base, around a first axis extending in a second direction intersecting with the first direction; a head holding member being slidable with respect to the base in a third direction intersecting with the first direction and the second direction and holding the thermal head such that the heating elements face the third direction; a first magnetic member positioned on a first side in the first direction relative to the first engagement member; a second magnetic member positioned on the first side in the first direction relative to the second engagement member; and a head pressing member facing the head holding member from a first side in the third direction.

16 Claims, 16 Drawing Sheets

(51) Int. Cl.

| | |
|---|---|
| ***B41J 2/325*** | (2006.01) |
| ***B41J 25/308*** | (2006.01) |
| ***B41J 25/312*** | (2006.01) |
| ***B41J 19/00*** | (2006.01) |
| ***B41J 29/02*** | (2006.01) |
| ***B41J 33/14*** | (2006.01) |

(52) U.S. Cl.
CPC ..... *B41J 2202/30* (2013.01); *B41J 2202/31* (2013.01)

(56) References Cited

U.S. PATENT DOCUMENTS

| | | | | |
|---|---|---|---|---|
| 6,236,420 | B1 * | 5/2001 | Matsuzaka | B41J 2/32 347/170 |
| 6,313,856 | B1 * | 11/2001 | Ulrich | B41J 2/325 347/171 |
| 6,398,335 | B1 * | 6/2002 | Benjamin | B41J 2/1752 347/19 |
| 8,007,190 | B2 * | 8/2011 | McNestry | B41J 2/325 400/120.01 |
| 8,937,634 | B2 | 1/2015 | Morgan et al. | |
| 2016/0288541 | A1 * | 10/2016 | Kano | B41J 11/70 |

FOREIGN PATENT DOCUMENTS

| | | | |
|---|---|---|---|
| JP | 2001-225495 | A | 8/2001 |
| JP | 2002-264398 | A | 9/2002 |

* cited by examiner

PRINTING APPARATUS

CROSS REFERENCE TO RELATED APPLICATION

The present application claims priority from Japanese Patent Application No. 2017-108117 filed on May 31, 2017, the disclosure of which is incorporated herein by reference in its entirety.

BACKGROUND

Field of the Invention

The present disclosure relates to a printing apparatus.

Description of the Related Art

In a thermal-transfer printing apparatus using a thermal head, it is preferable that pressing force be applied uniformly to an ink ribbon to ensure printing quality. A publicly known printing apparatus includes a thermal head, a head fixing member, and a head self-aligning support shaft. The head fixing member fixes the thermal head. The head self-aligning support shaft is attached to the head fixing member at a position substantially the same as a barycentric position of the head fixing member. The head fixing member is pivotally supported around the head self-aligning support shaft.

SUMMARY

A printing apparatus according to a first aspect of the present disclosure includes: a base; a thermal head including heating elements arranged in a first direction; a first engagement member provided in the thermal head; a second engagement member facing the first engagement member in a second direction intersecting with the first direction and configured to engage with the first engagement member such that the thermal head pivotally moves, relative to the base, around a first axis extending in the second direction, a head holding member having the second engagement member, being slidable with respect to the base in a third direction intersecting with the first direction and the second direction, and holding the thermal head such that the heating elements face the third direction, a first magnetic member provided in the thermal head and positioned on a first side in the first direction relative to the first engagement member; a second magnetic member provided in the head holding member, positioned on the first side in the first direction relative to the second engagement member, and facing the first magnetic member in the second direction so that the first magnetic member and the second magnetic member are attracted to each other by magnetic force, in a case that the first engagement member is engaged with the second engagement member; and a head pressing member supported by the base to pivotally move around a second axis extending in the second direction and configured to face the head holding member from a first side in the third direction.

A printing apparatus according to a second aspect of the present disclosure includes: a base; a thermal head including heating elements arranged in a front-rear direction; a first engagement member provided in the thermal head; a second engagement member facing the first engagement member in a left-right direction intersecting with the front-rear direction and configured to engage with the first engagement member such that the thermal head pivotally moves, relative to the base, around a first axis extending in the left-right direction;

a head holding member having the second engagement member, being slidable with respect to the base in an up-down direction intersecting with the front-rear direction and the left-right direction, and holding the thermal head such that the heating elements face downward; a first magnetic member provided in the thermal head and positioned on a first side in the front-rear direction relative to the first engagement member; a second magnetic member provided in the head holding member, positioned on the first side in the front-rear direction relative to the second engagement member, and facing the first magnetic member in the left-right direction so that the first magnetic member and the second magnetic member are attracted to each other by magnetic force, in a case that the first engagement member is engaged with the second engagement member; and a head pressing member supported by the base to pivotally move around a second axis extending in the left-right direction and configured to press the head holding member from above.

DESCRIPTION OF THE EMBODIMENTS

During a non-printing period in which no printing is performed, the thermal head is typically positioned at a standby position adjacent to the ink ribbon that is different from a printing position where printing is performed. In the printing apparatus using the head self-aligning support shaft, for example, a placement direction of the printing apparatus relative to a platen is not correct in some cases. In that case, when the thermal head is at the standby position during the non-printing period, the thermal head is liable to be inclined to a conveyance path of the ink ribbon with the head self-aligning support shaft as the center. The inclination of the thermal head at the standby position to the conveyance path of the ink ribbon may cause various problems. For example, when the ink ribbon is attached to the printing apparatus in that situation, the thermal head at the standby position may make contact with the ink ribbon positioned in the conveyance path.

An object of the present disclosure is, for example, to provide a printing apparatus that uniformly applies pressing force from a thermal head to an ink ribbon and reduces the possibility in which the thermal head is inclined to a conveyance path of the ink ribbon during movement of the thermal head from a printing position.

The following explains an embodiment of the present disclosure with reference to the drawings. In the following, a first direction, a second direction, and a third direction of a printing apparatus 1 are defined as a front-rear direction, a left-right direction, and an up-down direction respectively. In this embodiment, the first direction and the second direction are perpendicular to the third direction and the first direction is orthogonal to the second direction. In the left-right direction, a direction in which a thermal head 3 is positioned relative to a head holding member 4 is referred to as a head holding direction.

Figure 1:
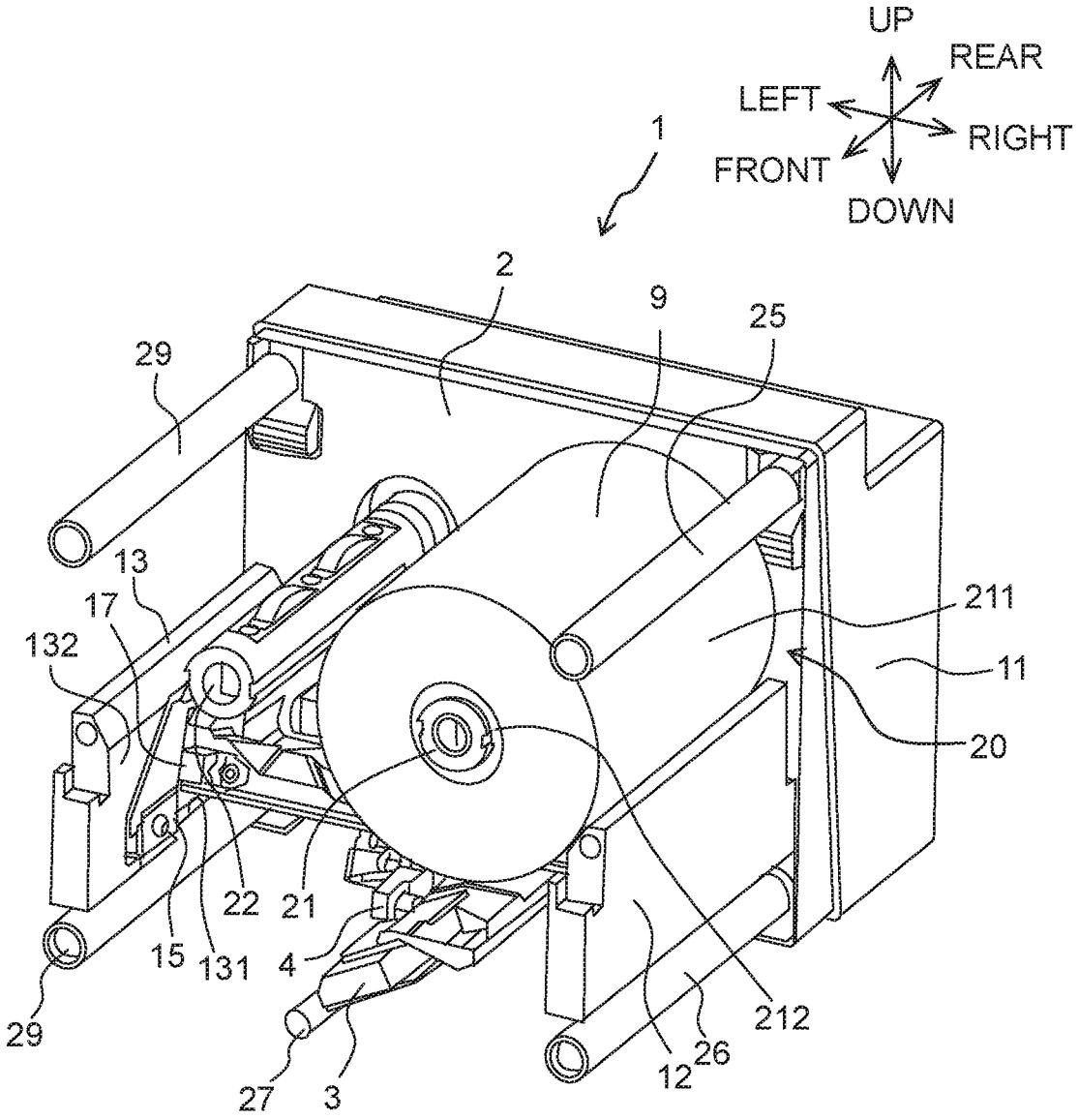
FIG. 1 is a perspective view of a printing apparatus 1.

The printing apparatus 1 depicted in FIG. 1 is a thermal transfer printing apparatus. The printing apparatus 1 is driven in synchronization with a printing medium conveyance apparatus (not depicted). The printing medium conveyance apparatus conveys a long printing medium 8 (see FIG. 7) at a predefined conveyance speed in the left-right direction. The printing medium 8 is, for example, a tube-shaped packaging material that is to be manufactured as food bags. The printing apparatus 1 prints, for example, a string of letters indicating a best-before date on the printing medium 8 at predefined intervals.

Figure 2:
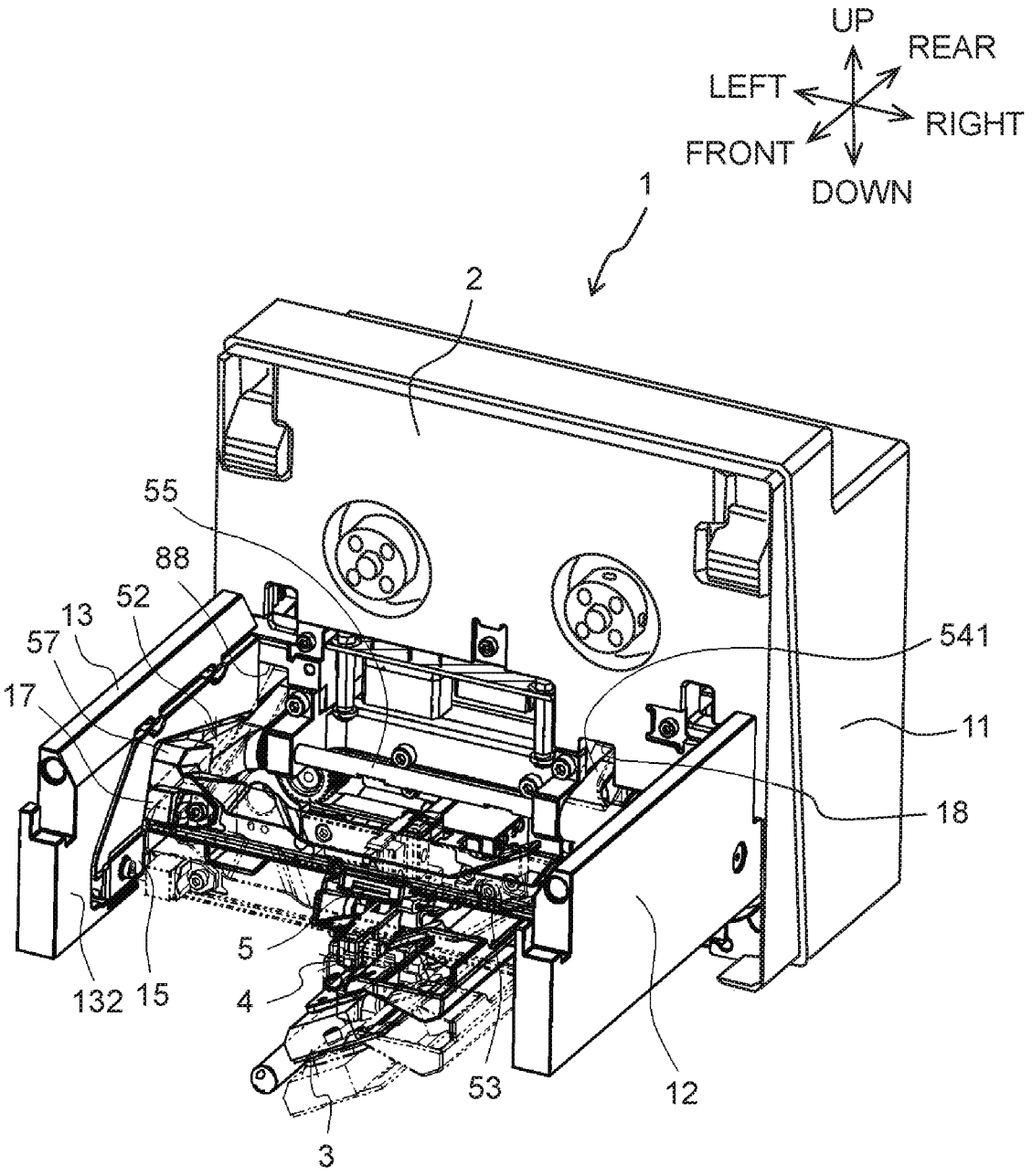
FIG. 2 is a perspective view of the printing apparatus 1 from which a ribbon conveyance mechanism 20 is removed.
Figure 3:
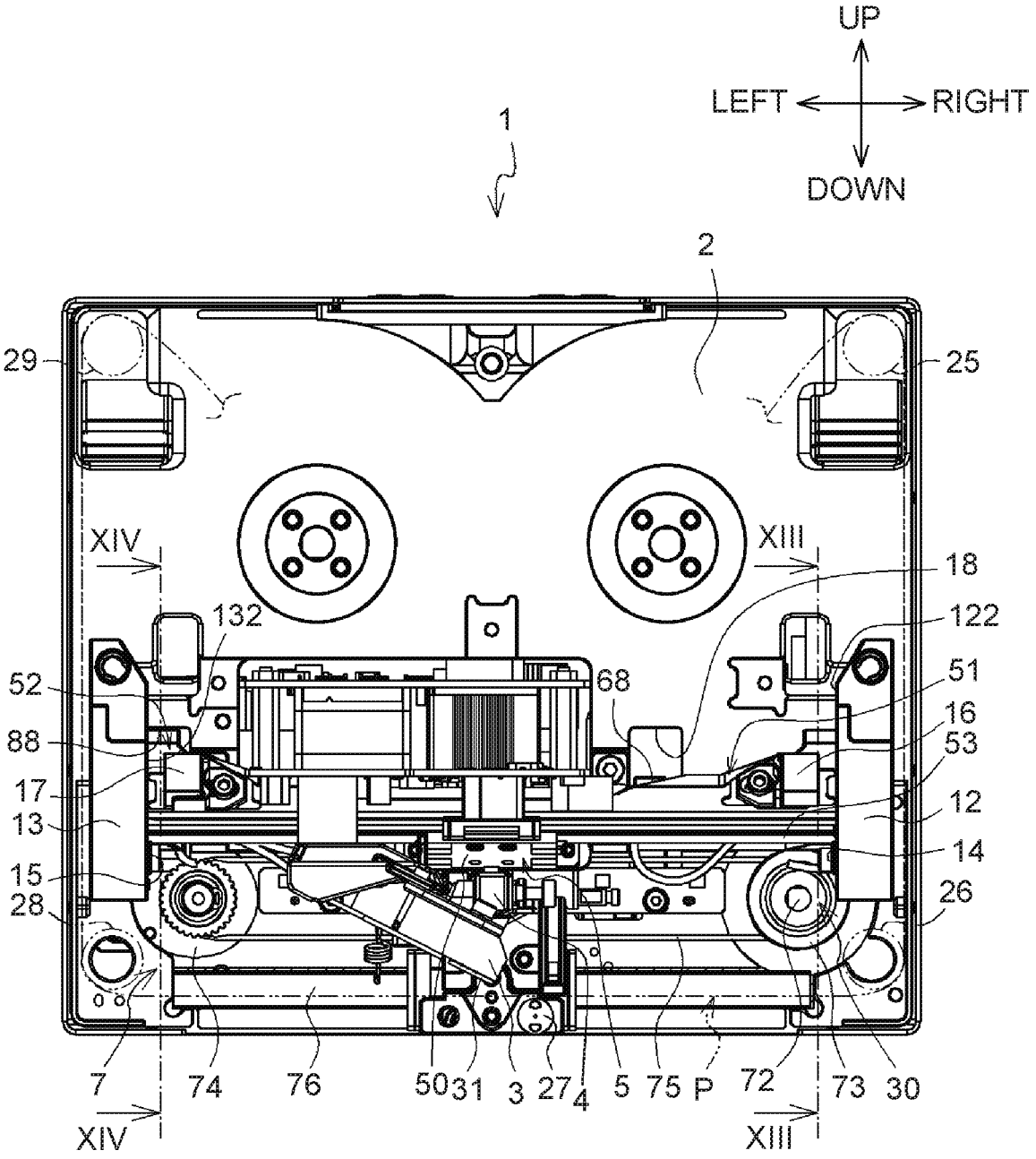
FIG. 3 is a front view of the printing apparatus 1 from which the ribbon conveyance mechanism 20 is removed.

As depicted in FIGS. 1 to 3, the printing apparatus 1 includes a base 2, the thermal head 3, and the head holding member 4. The thermal head 3 includes heating elements 31 arranged in the front-rear direction. The head holding member 4 slides on the base 2 in the up-down direction intersecting with the front-rear direction and the left-right direction. The head holding member 4 holds the thermal head 3 such that the heating elements 31 face the front-rear direction. The printing apparatus 1 further includes a ribbon conveyance mechanism 20, a movement assembly 30, and a second movement mechanism 7. The ribbon conveyance mechanism 20 conveys an ink ribbon 9 in a predefined conveyance direction while holding it. The movement assembly 30 moves the head holding member 4 in the up-down direction. The second movement mechanism 7 moves the head holding member 4 in the left-right direction. Details of components of the printing apparatus 1 will be explained below.

<Base 2>

The base 2 supports various components of the printing apparatus 1, such as the thermal head 3 and the head holding member 4. The base 2 in this embodiment is formed by a rectangular metal plate. The base 2 has holes 18 and 88 penetrating in the front-rear direction. The printing apparatus 1 includes a cover 11. The cover 11 is a box-shaped cover covering a back side of the base 2. The printing apparatus 1 includes a first pillar 12 and a second pillar 13. The first pillar 12 and the second pillar 13 are plate-shaped members extending frontward from a front surface of the base 2. The first pillar 12 is connected to a right end of the base 2. The second pillar 13 is connected to a left end of the base 2. The first pillar 12 and the second pillar 13 are separated from each other in the left-right direction and extend parallel to each other. Upper ends of the first pillar 12 and the second pillar 13 are in the vicinity of the center of the base 2 in the up-down direction. The upper ends of the first pillar 12 and the second pillar 13 are above upper ends of the holes 18 and 88. Lower ends of the first pillar 12 and the second pillar 13 are above a lower end of the base 2.

Figure 13:
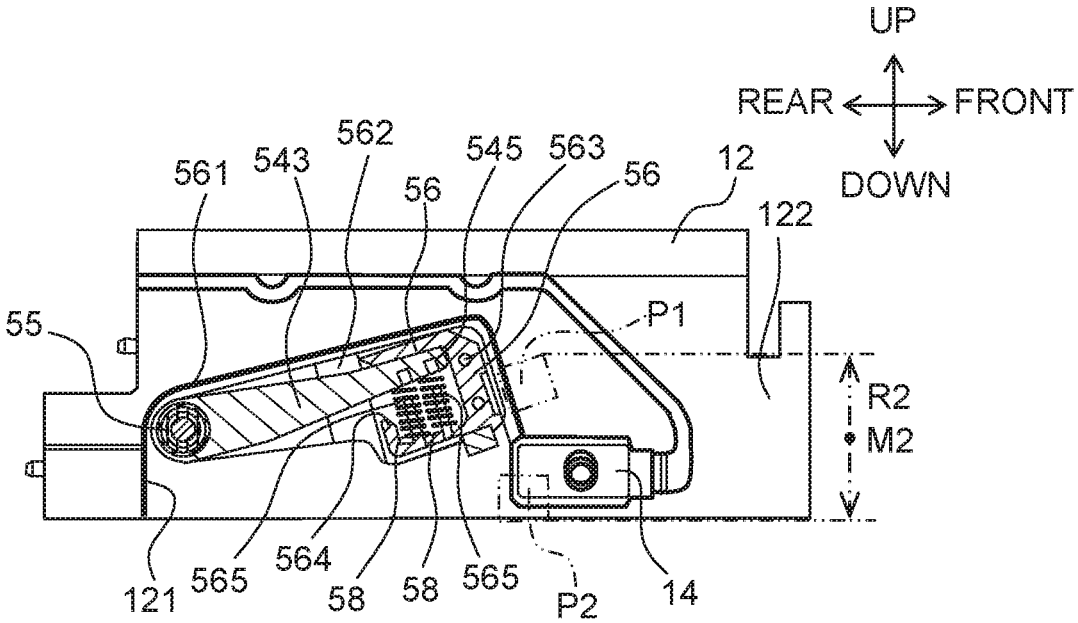
FIG. 13 is a cross-sectional view taken along an arrow XIII-XIII in FIG. 3.

As depicted in FIG. 13, a left surface 122 of the first pillar 12 is provided with a first sensor 14. The first sensor 14 outputs a signal corresponding to a position of a first detection member 16 described later in the up-down direction. The left surface 122 of the first pillar 12 has a recess 121 recessed rightward. The recess 121 is shaped to correspond to a pivoting range of a first pivoting member 51 described later when seen from the left side. The first sensor 14 is disposed on the front side of the recess 121 and the first pivoting member 51. The recess 121 is disposed on the rear side of the first sensor 14 and the front side of the base 2 in the front-rear direction. The recess 121 extends from a slightly upper portion of the first pillar 12 relative to the center of the first pillar 12 in the up-down direction to a lower end of the first pillar 12.

As depicted in FIGS. 1 and 2, a right surface 132 of the second pillar 13 is provided with a second sensor 15. The second sensor 15 outputs a signal corresponding to a position of a second detection member 17 described later in the up-down direction. As depicted in FIG. 1, the right surface 132 of the second pillar 13 is provided with a recess 131 recessed leftward. The right surface 132 of the second pillar 13 and the left surface 122 of the first pillar 12 extend parallel to each other. The recess 131 is shaped to correspond to a pivoting range of a second pivoting member 52 described later when seen from the right side. The second sensor 15 is disposed on the front side of the recess 131 and the second pivoting member 52. The recess 131 is disposed on the rear side of the second sensor 15 and the front side of the base 2 in the front-rear direction. The recess 131 extends from a slightly upper portion of the second pillar 13 relative to the center of the second pillar 13 in the up-down direction to a lower end of the second pillar 13.

<Ribbon Conveyance Mechanism 20>

Figure 4:
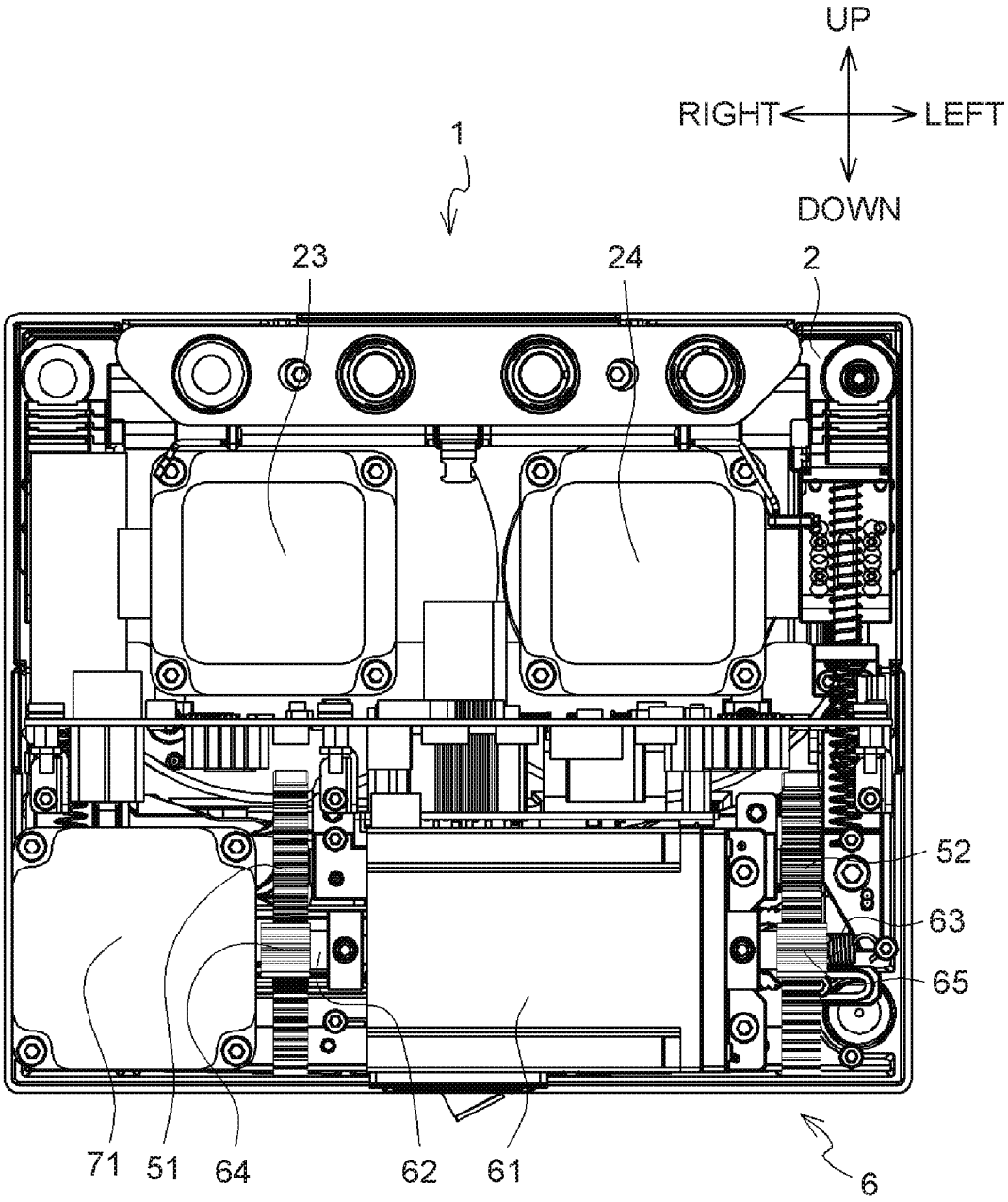
FIG. 4 is a back view of the printing apparatus 1 from which a cover 11 is removed.

As depicted in FIGS. 1 and 4, the ribbon conveyance mechanism 20 of the printing apparatus 1 includes a first attachment part 21, a second attachment part 22, a first ribbon motor 23, a second ribbon motor 24, and guide shafts 25 to 29. The first attachment part 21 and the second attachment part 22 are shafts extending in the front-rear direction. The first attachment part 21 and the second attachment part 22 are rotatably supported by the front surface of the base 2. A first roll 211 is removably attached to the first attachment part 21 by inserting the first attachment part 21 into a hole of a cylindrical core shaft 212. A second roll (not depicted) is removably attached to the second attachment part 22 by inserting the second attachment part 22 into a hole of a cylindrical core shaft (not depicted). Namely, the first attachment part 21 and the second attachment part 22 are spindles that are rotatably held by the base 2.

The ink ribbon 9, which is in a belt shape, is formed by an ink layer and a base material. The base material may be, for example, polyethylene terephthalate (PET). The ink layer may contain, for example, a coloring component such as carbon and a binder component such as wax and/or resin. The ink ribbon 9 is conveyed below the thermal head 3 such that the ink layer faces the printing medium 8. The ink layer melted by heating is transferred to the printing medium 8. The ink ribbon 9 may include a functional layer as needed, such as a back coating layer, a peeling layer, and/or an adhesion layer. A first end of the ink ribbon 9 is connected to a side surface of the core shaft 212 of the first roller 211, and a second end of the ink ribbon 9 is connected to a side surface of the core shaft of the second roll.

Figure 5:
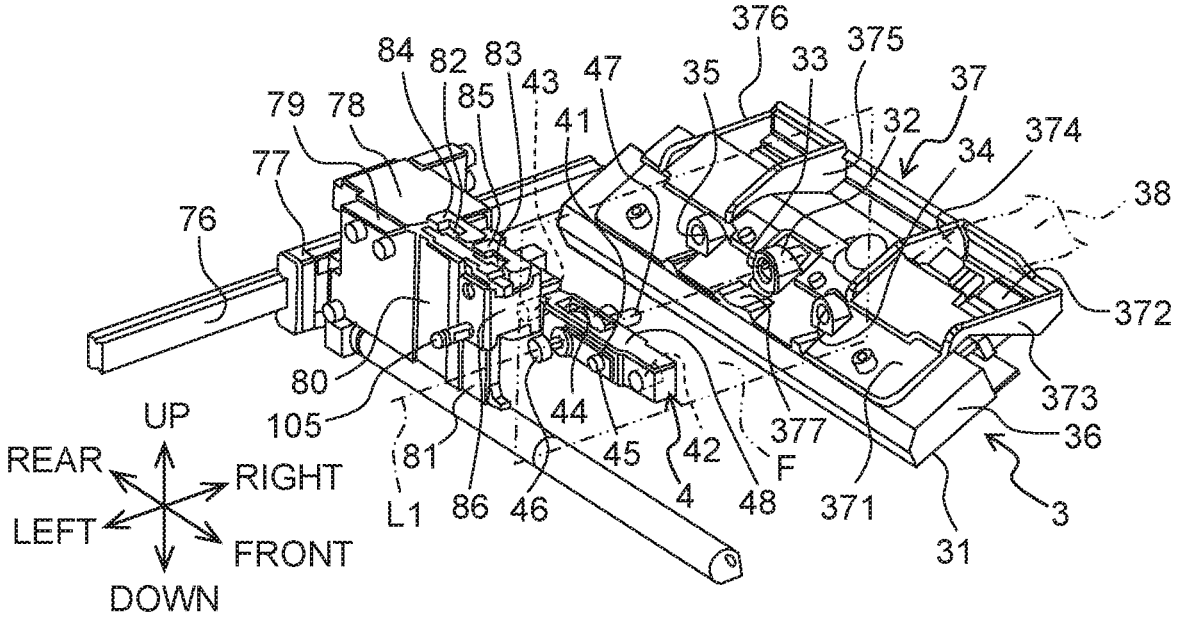
FIG. 5 is a perspective view depicting a state in which a thermal head 3 is attached to a head holding member 4 to have a first posture.

The guide shafts 25 to 29 define a conveyance path P of the ink ribbon 9. Each of the guide shafts 25 to 29 has a cylindrical shape and may be, for example, a roller that is rotatable around a rotation shaft extending in the front-rear direction. Each of the guide shafts 25, 26, 28, and 29 extends frontward from the front surface of the base 2. A part of a circumferential surface of each guide shaft makes contact with a surface, of the ink ribbon 9, opposite to a surface formed with the ink layer. As depicted in FIG. 5, the guide shaft 27 is removably attached to a sliding member 77 described later. The guide shaft 27 extends frontward from a front surface of the sliding member 77. A part of a circumferential surface of the guide shaft 27 makes contact with the surface of the ink ribbon 9 formed with the ink layer. The ink ribbon 9 is guided and conveyed by each of the guide shafts 25 to 29. The guide shaft 25 is disposed in the vicinity of an upper right corner of the base 2. The guide shaft 26 is disposed in the vicinity of a lower right corner of the base 2. The guide shaft 27 is disposed at a lower portion of the base 2 at a position on a slightly left side of the center of the base 2 in the left-right direction. The guide shaft 28 is disposed in the vicinity of a lower left corner of the base 2. The guide shaft 29 is disposed in the vicinity of an upper left corner of the base 2. As depicted in FIGS. 2 and 3, the first attachment part 21, the second attachment part 22, and the guide shafts 25, 26, 28, and 29 can be removed from the base 2.

As depicted by virtual lines in FIG. 3, when the thermal head 3 is positioned at a standby position described later, the conveyance path P of the ink ribbon 9 extends toward the upper right side from the first attachment part 21 (see FIG. 1), changes its extending direction by making contact with the guide shaft 25, and then extends downward to the guide shaft 26. The conveyance path P between the guide shaft 25 and the guide shaft 26 is positioned on the right of the first pillar 12 and separated from the first pillar 12. The conveyance path P changes its extending direction by making contact with the guide shaft 26 and then extends leftward to the guide shaft 27. At a position between the guide shaft 26 and the guide shaft 28, the conveyance path P makes contact with or approaches a lower end of the thermal head 3 and an upper end of the guide shaft 27. The conveyance path P changes its extending direction by making contact with the guide shaft 28, and extends upward to the guide shaft 29. The conveyance path P between the guide shaft 28 and the guide shaft 29 is positioned on the left of the second pillar 13 and separated from the second pillar 13. The conveyance path P changes its extending direction by making contact with the guide shaft 29, and then extends toward the lower right side to reach the second attachment part 22 (see FIG. 1). Rotation of the first attachment part 21 and the second attachment part 22 moves the ink ribbon 9 between the guide shaft 26 and the guide shaft 28 in the left-right direction.

As depicted in FIG. 4, the first ribbon motor 23 and the second ribbon motor 24 are disposed on the back surface of the base 2. The first ribbon motor 23 rotates the first attachment part 21. The second ribbon motor 24 rotates the second attachment part 22. Each of the first ribbon motor 23 and the second ribbon motor 24 is, for example, a stepper motor rotating forwardly and reversely. The first attachment part 21 is connected directly to an output shaft of the first ribbon motor 23. Namely, a rotation shaft of the first attachment part 21 is positioned on the same straight line as the output shaft of the first ribbon motor 23. The rotation amount of the first ribbon motor 23 is equal to the rotation amount of the first attachment part 21. A rotation shaft of the second attachment part 22 is connected directly to an output shaft of the second ribbon motor 24. Namely, the rotation shaft of the second attachment part 22 is positioned on the same straight line as the output shaft of the second ribbon motor 24. The rotation amount of the second ribbon motor 24 is equal to the rotation amount of the second attachment part 22. The first attachment part 21 and the second attachment part 22 are rotated by different motors, and thus they can rotate at mutually different rotation speeds. A controller 67 (see FIG. 18) rotates the first ribbon motor 23 and the second ribbon motor 24 in a direction corresponding to the conveyance direction of the ink ribbon 9 at a speed corresponding to the conveyance speed of the ink ribbon 9.

<Thermal Head 3>

As depicted in FIGS. 1 to 3, the thermal head 3 is disposed on the front side of the front surface of the base 2 in the front-rear direction. The thermal head 3 is disposed below the first attachment part 21 and the second attachment part 22. The thermal head 3 is a line thermal head including the heating elements 31 arranged linearly in the first direction. More specifically, the thermal head 3 is configured such that a lower corner of a plate-shaped ceramic substrate 36 extending in the front-rear direction is chamfered (i.e., a chamfer) and a glaze layer and the heating elements 31 are arranged on the chamfer. The heating elements 31 are arranged along an edge of the thermal head 3 extending in the front-rear direction in a state of facing the lower side that is a first side in the up-down direction. The thermal head 3 is adjacent to the conveyance path P of the ink ribbon 9. When the printing apparatus 1 performs printing, the movement assembly 30 allows the thermal head 3 to move in the up-down direction between a position depicted by a solid line in FIG. 2 and a position depicted by a virtual line in FIG. 2. The thermal head 3 approaches or makes contact with a platen 19 (see FIG. 7) disposed therebelow when positioned at a printing position corresponding to a lower end of a movement range of the thermal head 3 in the up-down direction. The platen 19 in this embodiment has a flat plate shape. The platen 19 may have a roller-like shape, for example, when the printing apparatus 1 performs printing without moving the thermal head 3 in the left-right direction. The platen 19 faces the lower side of the thermal head 3 positioned at the printing position. The platen 19 presses the printing medium 8 against the thermal head 3 in response to the movement of the thermal head 3 to the printing position.

Figure 7A:
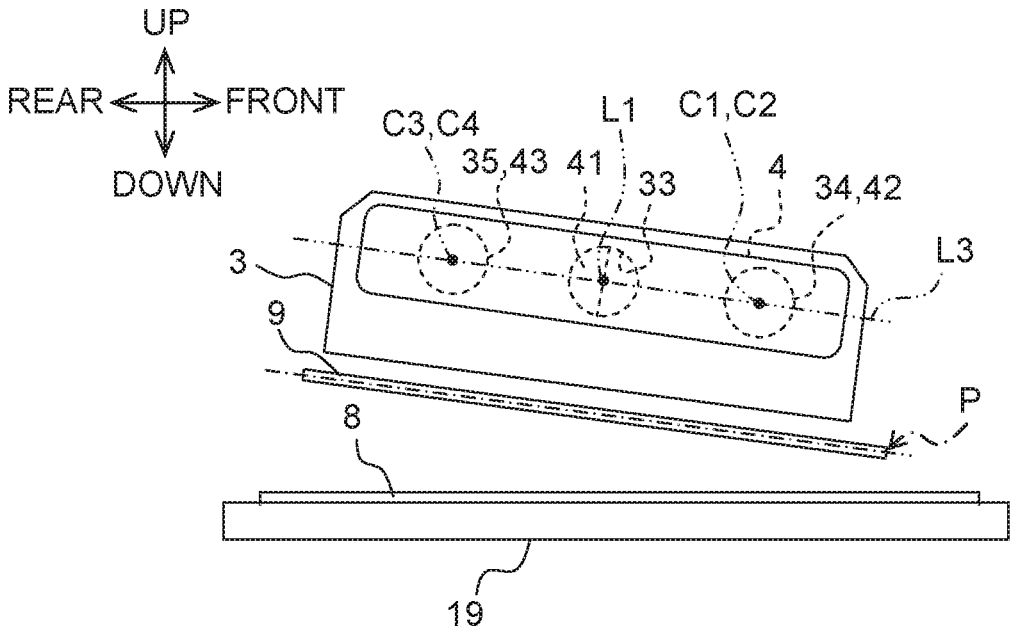
FIGS. 7A and 7B each depict a state in which an extending direction of the head holding member 4 is inclined to a platen 19 in a front-rear direction, FIG. 7A schematically depicting the head holding member 4 and the thermal head 3 that is held by the head holding member 4 to have the first posture and is positioned at a standby position, FIG. 7B schematically depicting the head holding member 4 and the thermal head 3 that is held by the head holding member 4 to have the first posture and is positioned at a printing position.
Figure 7B:
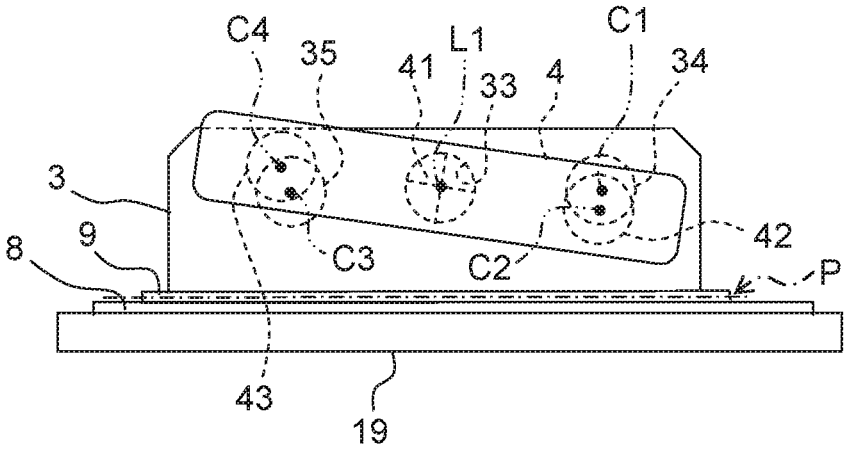

The thermal head 3 is positioned at the standby position in a printing standby mode. As schematically depicted in FIG. 7A, the standby position is a position where the lower end of the thermal head 3 approaches or make contact with the ink ribbon 9 extending in the left-right direction while being separated from the platen 19. The standby position is on the lower side of an upper end of the movement range of the thermal head 3 in the up-down direction so that the thermal head 3 can be separated from the ink ribbon 9. In this embodiment, the position where the thermal head 3 is separated from the ink ribbon 9 is a position where the lower end of the thermal head 3 is above a line connecting a lower end of the guide shaft 26 and a lower end of the guide shaft 28, that is, above the conveyance path P of the ink ribbon 9 between the guide shaft 26 and the guide shaft 28 depicted in FIG. 3. The printing position is a position where the lower end of the thermal head 3 is in contact with the platen 19 in a state where no printing medium 8 is placed between the thermal head 3 and the platen 19. When the printing medium 8 is placed between the thermal head 3 and the platen 19, the thermal head 3 at the printing position is in contact with the platen 19 with the ink ribbon 9 and the printing medium 8 intervening therebetween, as schematically depicted in FIG. 7B. When the thermal head 3 is at the printing position, the conveyance path P of the ink ribbon 9 is changed by the thermal head 3. Specifically, the conveyance path P of the ink ribbon 9 is changed between the guide shaft 26 and the guide shaft 28 unlike a case in which the thermal head 3 is at the standby position. Although it is not illustrated, when the head holding direction is the left side as depicted in FIG. 3, the conveyance path P of the ink ribbon 9 with the thermal head 3 being at the printing position extends leftward from the guide shaft 26 to reach the guide shaft 27. The conveyance path P changes its extending direction by making contact with the guide shaft 27 and then extends obliquely downward to the left toward the lower end of the thermal head 3. The conveyance path P changes its extending direction by making contact with the lower end of the thermal head 3 and then extends obliquely upward to the left to reach the guide shaft 28. In replacement of the ink ribbon 9 by another, the thermal head 3 is positioned at a retreat position. The retreat position is at the upper end of the movement range of the thermal head 3 in the up-down direction. The retreat position is above the standby position.

Figure 10:
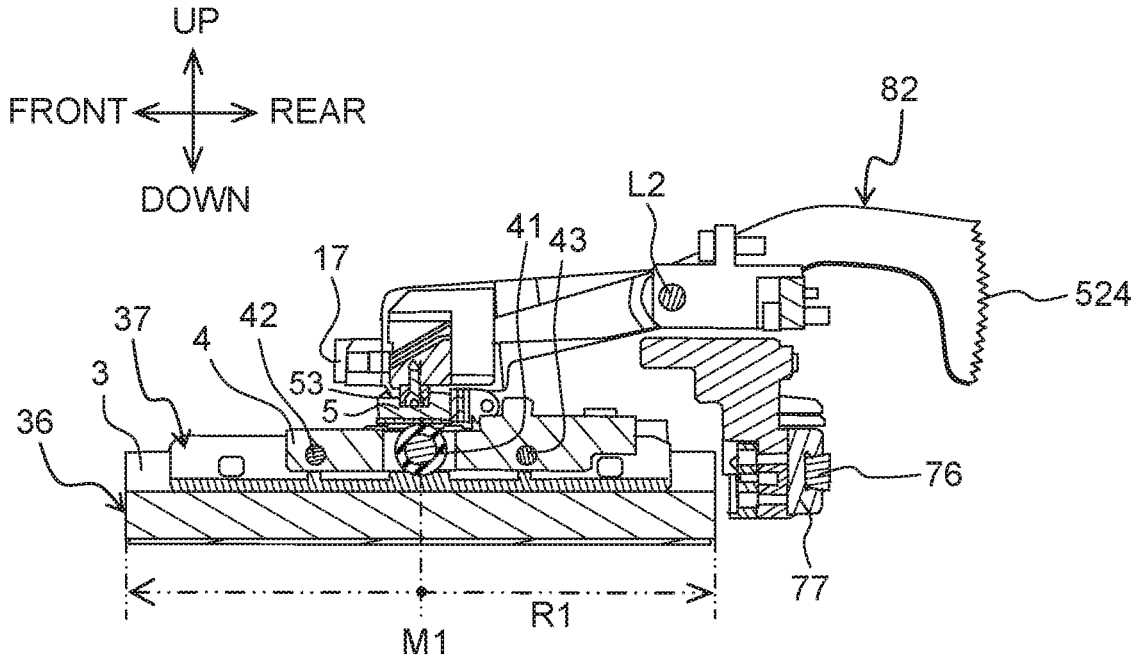
FIG. 10 is a cross-sectional view taken along an arrow X-X in FIG. 9.

As depicted in FIG. 5, in the thermal head 3, an upper surface of the ceramic substrate 36 is provided with an attachment part 37. The upper surface of the ceramic substrate 36 is a surface opposite to the surface formed with the heating elements 31. As depicted in FIG. 10, a front end of the attachment part 37 is on the rear side of a front end of the ceramic substrate 36. A rear end of the attachment part 37 is on the front side of a rear end of the ceramic substrate 36. The center of the ceramic substrate 36 in the front-rear direction substantially coincides with the center of the attachment part 37 in the front-rear direction. The attachment part 37 has a first part 371 and a second part 372. The first part 371 extends in the front-rear direction to be connected to the upper surface of the ceramic substrate 36. The first part 371 of the attachment part 37 of the thermal head 3 includes a first engagement member 32, a first magnetic member 34, and a third magnetic member 35. The first engagement member 32 is a member to engage with a second engagement member 41 described later. The first engagement member 32 in this embodiment has an engagement hole 33 extending in the left-right direction. The engagement hole 33 has a circular shape when seen in side view and an area extended from the engagement hole 33 in its extending direction (left-right direction) intersects with the upper surface of the ceramic substrate 36. The second engagement member 41 is removably inserted into the first engagement member 32. The first engagement member 32 is provided at the center of a longitudinal range R1 of the thermal head 3 in the front-rear direction. The center of the longitudinal range R1 of the thermal head 3 in the front-rear direction is a part including the center of gravity of the thermal head 3 in the front-rear direction.

Figure 6:
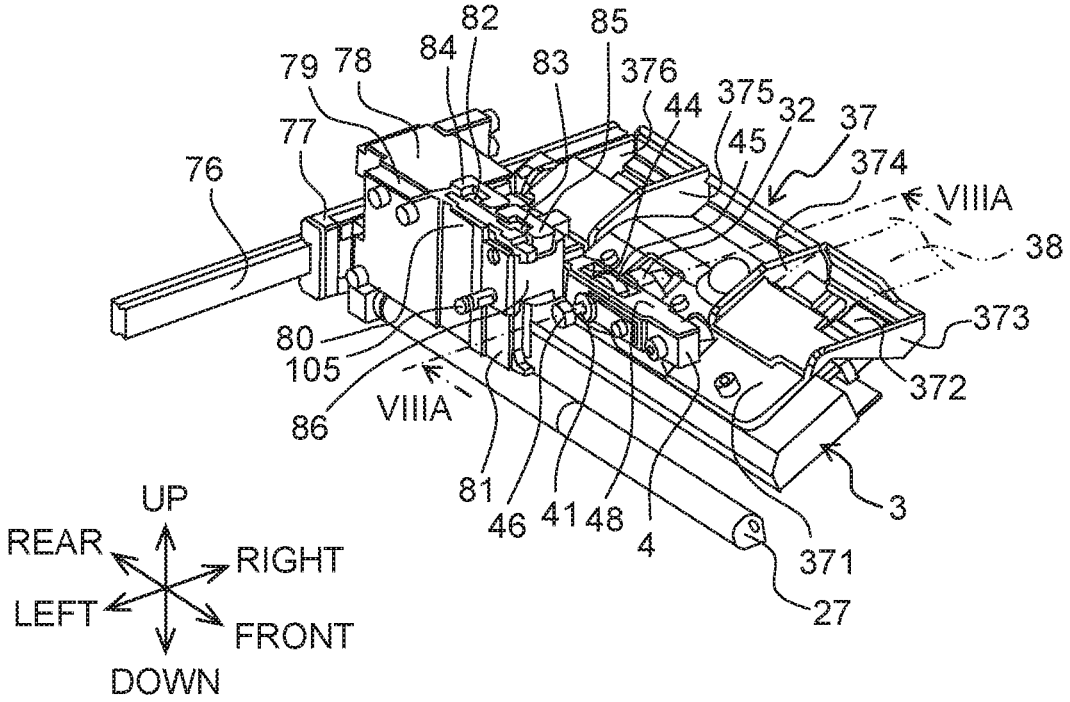
FIG. 6 is a perspective view of the thermal head 3 that is held by the head holding member 4 to have the first posture.

When the head holding direction is the right side as depicted in FIGS. 5 and 6, the first magnetic member 34 is positioned on the front side of the engagement hole 33 of the first engagement member 32, the front side being a first side in the front-rear direction. The third magnetic member 35 is positioned on the rear side of the engagement hole 33 of the first engagement member 32, the rear side being a second side in the front-rear direction. The third magnetic member 35 and the first magnetic member 34 are positioned symmetrically with respect to a virtual surface F including a first axis L1 described later and extending in the up-down direction. The first magnetic member 34 and the third magnetic member 35 are respectively inserted into holes of the first part 371 extending in the left-right direction. One of magnetic poles of each of the magnetic member 34 and the third magnetic member 35 is exposed to a side opposite to the head holding direction (the left side in FIG. 5). Each of the first magnetic member 34 and the third magnetic member 35 in this embodiment has a circular shape when seen in side view. The first magnetic member 34, the third magnetic member 35, and the engagement hole 33 have the substantially same size in side view. The first part 371 of the thermal head 3 has a curved surface 377. The curved surface 377 is positioned below the head holding member 4 with the first engagement member 32 being engaged with the second engagement member 41. The curved surface 377 curves in the front-rear direction to have an arc-like shape depending on the outer circumference of a rolling member 45 described later. The curved surface 377 is positioned below the opening of the engagement hole 33 on the side opposite to the head holding direction (i.e., the left side in FIG. 5).

The second part 372 is connected to an end of the first part 371 in the head holding direction. An upper surface of the second part 372 is provided with flanges 373 to 376 extending in the left-right direction and protruding upward. The flanges 373 to 376 are arranged parallel to each other in the front-rear direction. The second part 372 is removably connected to a first end of a harness 38 connected to the heating elements 31. A second end of the harness 38 is connected to a substrate (not depicted) in which the controller 67 (see FIG. 18) is provided.

<Head Holding Member 4>

The head holding member 4 is a member having a square pole shape that extends in the front-rear direction. The head holding member 4 holds the thermal head 3 such that inclination of the thermal head 3 relative to a surface of the platen 19 (more specifically, the heating elements 31) is adjustable. Specifically, the head holding member 4 includes a second engagement member 41, a second magnetic member 42, and a fourth magnetic member 43. The second engagement member 41 faces the first engagement member 32 in the left-right direction orthogonal to the front-rear direction. The second engagement member 41 engages with the first engagement member 32 such that the thermal head 3 can pivot, relative to the base 2, around the first axis L1 extending in the left-right direction. The second engagement member 41 in this embodiment is a protrusion extending in the left-right direction. More specifically, the second engagement member 41 is a bar-like shaft having the first axis L1. A first end and a second end of the second engagement member 41 in the left-right direction have mutually different shapes. The first end of the second engagement member 41, which is an engagement end 47, engages with the first engagement member 32. A front end of the engagement end 47 is chamfered into a hemisphere shape. The second end of the second engagement member 41 is provided with a flange 46 engaging with a guide groove 92 of a coupling member 90 described later. The flange 46 protrudes in an extending direction of the first axis L1. The flange 46 has a circular shape in side view.

The second magnetic member 42 is positioned on the front side of the second engagement member 41. When the first engagement member 32 is engaged with the second engagement member 41, the second magnetic member 42 faces the first magnetic member 34 in the left-right direction so that they are attracted to each other by magnetic force. The fourth magnetic member 43, which is disposed in the head holding member 4, is positioned on the rear side of the second engagement member 41. When the first engagement member 32 is engaged with the second engagement member 41 and the first magnetic member 34 faces the second magnetic member 42 in the left-right direction, the fourth magnetic member 43 faces the third magnetic member 35 in the left-right direction so that they are attracted to each other by magnetic force. The fourth magnetic member 43 and the second magnetic member 42 are positioned symmetrically with respect to the virtual surface F.

In this embodiment, the first magnetic member 34, the second magnetic member 42, the third magnetic member 35, and the fourth magnetic member 43 are permanent magnets. Magnetic poles of the second magnetic member 42 and magnetic poles of the fourth magnetic member 43 are ends in the left-right direction, and the second magnetic member 42 and the fourth magnetic member 43 are held by the head holding member 4 such that their ends in the left-right direction are exposed from the head holding member 4. The second magnetic member 42 and the fourth magnetic member 43 in this embodiment are cylindrical permanent magnets extending in the left-right direction. The second magnetic member 42 and the fourth magnetic member 43 are inserted into and held by cylindrical holes of the head holding member 4 penetrating in the left-right direction. The second magnetic member 42 and the fourth magnetic member 43 have the same shape. The second magnetic member 42, the fourth magnetic member 43, the first magnetic member 34, and the third magnetic member 35 have the same shape in side view. One of the magnetic poles of the second magnetic member 42 in the left-right direction is different from one of the magnetic poles of the fourth magnetic member 43 in the left-right direction. The magnetic pole of the first magnetic member 34 on the side facing the head holding member 4 is different from the magnetic pole of the third magnetic member 35 on the side facing the head holding member 4. More specifically, the magnetic pole of the first magnetic member 34 exposed from the first part 371 on the side opposite to the head holding direction is different from the magnetic pole of the third magnetic member 35 exposed from the first part 371 on the side opposite to the head holding direction. When the first engagement member 32 is engaged with the second engagement member 41, the first magnetic member 34 faces the second magnetic member 42 such that mutually different magnetic poles face each other in the left-right direction and the third magnetic member 35 faces the fourth magnetic member 43 such that mutually different magnetic poles face each other in the left-right direction. For example, as depicted in FIG. 8C, a north pole of the first magnetic member 34 faces a south pole of the second magnetic member 42. Similarly, a south pole of the third magnetic member 35 faces a north pole of the fourth magnetic member 43. When a right magnetic pole of the second magnetic member 42 is the south pole, a right magnetic pole of the fourth magnetic member 43 is the north pole. When the magnetic pole of the first magnetic member 34 exposed from the first part 371 is the north pole, the magnetic pole of the third magnetic member 35 exposed from the first part 371 is the south pole.

Figure 8A:
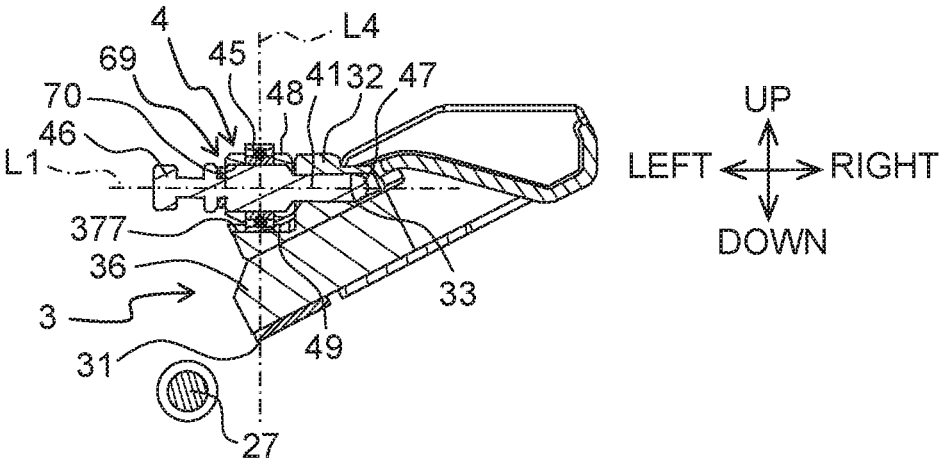
FIG. 8A is a cross-sectional view taken along an arrow VIIIA-VIIIA in FIG. 6.
Figure 8B:
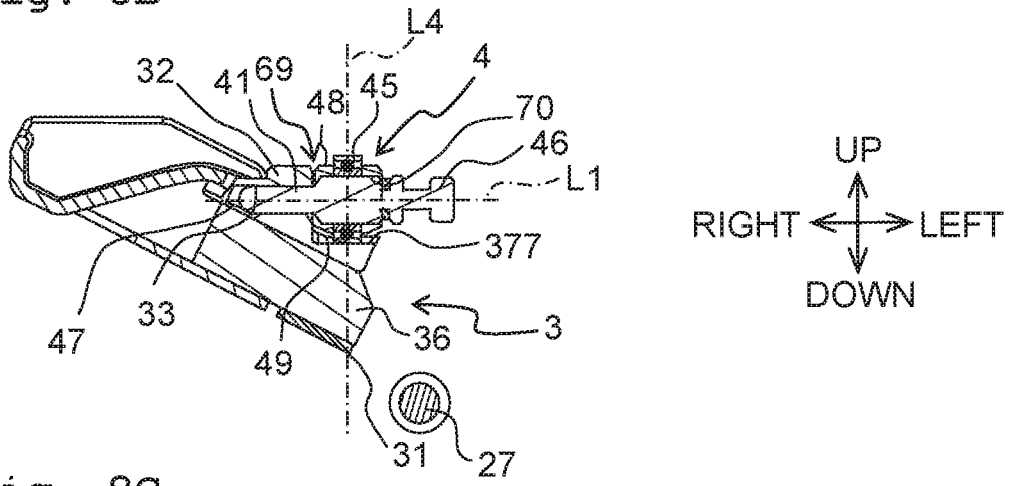
FIG. 8B is a cross-sectional view taken along an arrow VIIIB-VIIIB in FIG. 9.
Figure 8C:
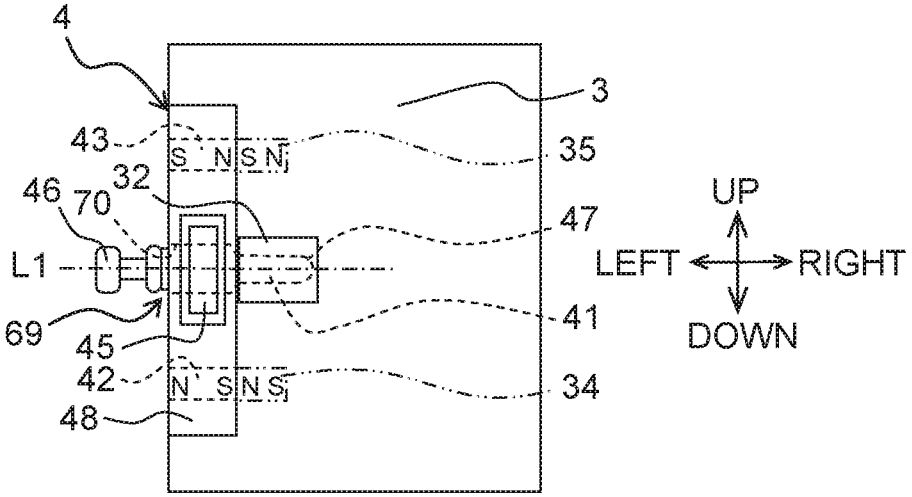
FIG. 8C is a schematic plan view of the thermal head 3 that is held by the head holding member 4 to have the first posture.

As depicted in FIGS. 6 and 8, the head holding member 4 has a hole 44 at a substantially center position in the front-rear direction, the hole 44 being open to the upper side. The rolling member 45, which is inserted into the hole 44, is pivotally held by the head holding member 4 around the first axis L1. The rolling member 45 in this embodiment is inserted into the second engagement member 41 and pivotally held by the head holding member 4 around the first axis L1. An upper end of the rolling member 45 protrudes upward beyond an upper surface 48 of the head holding member 4. The upper surface 48 of the head holding member 4, which is one of the surfaces of the head holding member 4, faces a head pressing member 5 described later. The upper end of the rolling member 45 may protrude upward beyond an upper end of the head holding member 4 or may not protrude upward beyond the upper end of the head holding member 4. The rolling member 45, which is in contact with a contact surface 50 that is a lower surface of the head pressing member 5, is pressed downward by the head pressing member 5. The hole 44 is open also to the lower side. Namely, the hole 44 in this embodiment penetrates in the up-down direction. A lower end of the rolling member 45 protrudes downward beyond a lower surface 49 of the head holding member 4. The lower surface 49 of the head holding member 4, which is one of the surfaces of the head holding member 4, faces the platen 19 (see FIG. 7). The lower end of the rolling member 45 may protrude downward beyond a lower end of the head holding member 4 or may not protrude downward beyond the lower end of the head holding member 4. The curved surface 377 of the thermal head 3 receives the rolling member 45 from the lower side when the first engagement member 32 is engaged with the second engagement member 41. The length of the curved surface 377 in the left-right direction is longer than the length of the rolling member 45 in the left-right direction. The pressing force from the head pressing member 5 is transmitted to the heating elements 31 via the curved surface 377 when the rolling member 45 is pressed downward by the head pressing member 5. As depicted in FIGS. 8A and 8B, an extending direction of a line L4 passing through the center of the rolling member 45 in the left-right direction and a position of the heating elements 31 in the left-right direction coincides with the up-down direction. The rolling member 45 in this embodiment is a bearing.

The first axis L1 of the second engagement member 41 preferably coincides substantially with a barycentric position of the thermal head 3 in the front-rear direction with the second engagement member 41 being engaged with the first engagement member 32. The barycentric position of the thermal head 3 in this embodiment substantially coincides with the center position in the front-rear direction. As depicted in FIG. 10, the position of the first axis L1 in the front-rear direction coincides with a center position M1 of the longitudinal range R1 of the thermal head 3 in the front-rear direction, namely, the barycentric position of the thermal head 3.

When the second engagement member 41 is engaged with the first engagement member 32, the first magnetic member 34 and the second magnetic member 42 are attracted to each other by magnetic force, and the third magnetic member 35 and the fourth magnetic member 43 are attracted to each other by magnetic force. The attraction between the first magnetic member 34 and the second magnetic member 42 by magnetic force causes static frictional force between the first magnetic member 34 and the second magnetic member 42. Similarly, the attraction between the third magnetic member 35 and the fourth magnetic member 43 by magnetic force causes static frictional force between the third magnetic member 35 and the fourth magnetic member 43. The sum of the moment around the first axis L1 due to the static frictional force between the first magnetic member 34 and the second magnetic member 42 and the moment around the first axis L1 due to the static frictional force between the third magnetic member 35 and the fourth magnetic member 43 is larger than the moment around the first axis L1 due to the gravity and external force received by the thermal head 3. The harness 38 is attached to the thermal head 3 at a position separated from the first engagement member 32 in the front-rear direction. The external force received by the thermal head 3 includes pressing force from the harness 38. Thus, as depicted in FIG. 7A, when the thermal head 3 is at the standby position, the position of the thermal head 3 relative to the head holding member 4 is a reference position where the first magnetic member 34 faces the second magnetic member 42 to have the strongest magnetic force therebetween (i.e., the distance between the first magnetic member 34 and the second magnetic member 42 is the shortest). When the position of the thermal head 3 relative to the head holding member 4 is the reference position, a center position C1 of the first magnetic member 34 coincides with a center position C2 of the second magnetic member 42. A center position (the first axis L1) of the second engagement member 41 coincides with a center position of the first engagement member 32. A center position C3 of the third magnetic member 35 coincides with a center position C4 of the fourth magnetic member 43.

Figure 17A:
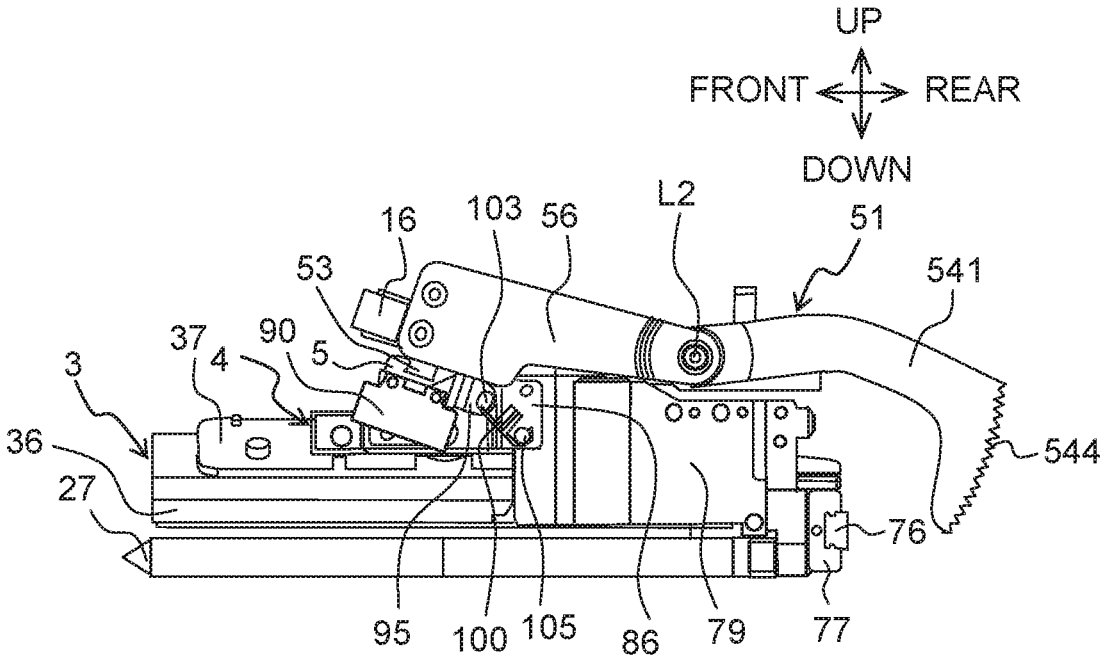
FIG. 17A is a right side view depicting a state in which the thermal head 3 is held by the head holding member 4 to have the second posture and is positioned at an upper end of a movement range of the thermal head 3 in an up-down direction.
Figure 17B:
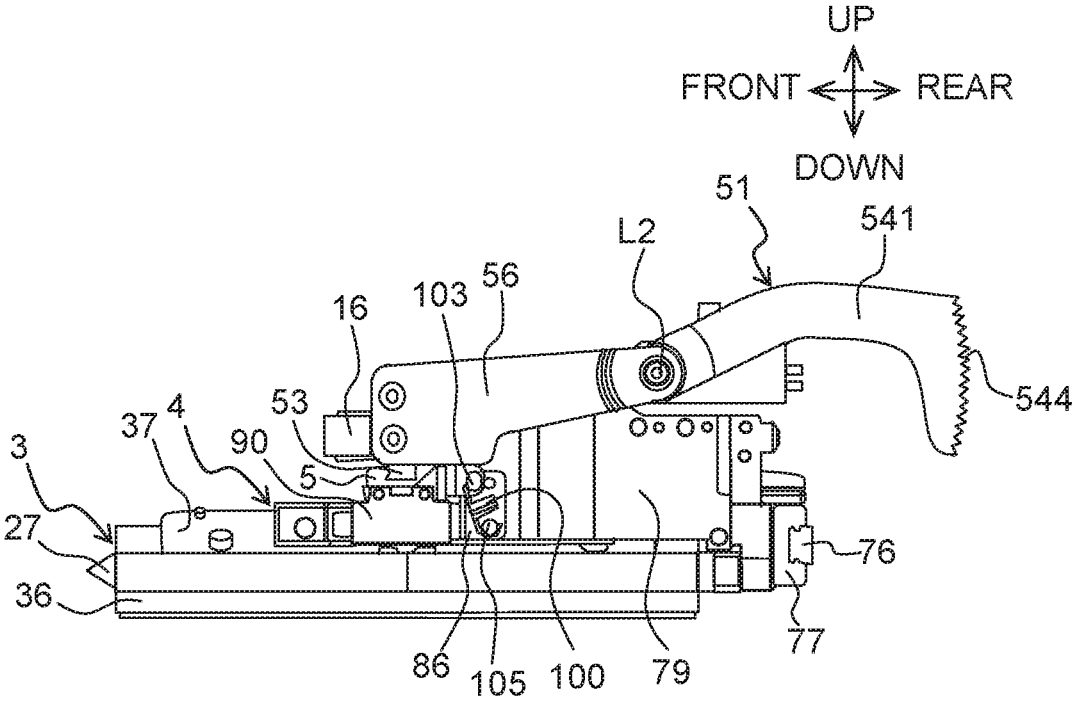
FIG. 17B is a right side view depicting a state in which the thermal head 3 is held by the head holding member 4 to have the second posture and is positioned at a lower end of the movement range of the thermal head 3 in the up-down direction.

When the position of the thermal head 3 relative to the head holding member 4 is the reference position, the center position C1 of the first magnetic member 34 coincides with a center position L1 of the first engagement member 32 in the up-down direction. In the up-down direction, the center position C2 of the second magnetic member 42 coincides with a center position L1 of the second engagement member 41. Here, the meaning of "coincides with" includes that the members coincide strictly with each other and that the members coincide with each other in a predefined acceptable range. The predefined acceptable range may be a range reflecting manufacture tolerance and the like, wherein the members are only required to coincide with each other in a range that is not more than 25% of the length of the magnetic member in the up-down direction. FIG. 7A stresses a state in which the arrangement direction of the heating elements 31 is inclined to the extending direction (front-rear direction) of the platen 19, such as a case in which the placement direction of the printing apparatus 1 relative to the platen 19 is not correct. Thus, in FIG. 7A, the center position C1 does not coincide with the center position L1 in the up-down direction. Meanwhile, as depicted in FIGS. 17A and 17B, when the placement direction of the printing apparatus 1 relative to the platen 19 is correct and the head holding member 4 is attached correctly to the base 2, the extending direction of the head holding member 4 is parallel to the front-rear direction. Thus, the center position C1 of the first magnetic member 34 typically coincides with the center position L1 of the first engagement member 32 in the up-down direction, and the center position C2 of the second magnetic member 42 typically coincides with the center position L1 of the second engagement member 41 in the up-down direction. When the first engagement member 32 is engaged with the second engagement member 41 with the thermal head 3 being at the reference position, a line L3 passing through the center position of the first magnetic member 34 and the center position of the first engagement member 32 coincides with the first direction, and the line L3 passing through the center position of the second magnetic member 42 and the center position of the second engagement member 41 coincides with the first direction.

When the thermal head 3 is at the printing position, the thermal head 3 receives pressing force directed downward from the head pressing member 5. The sum of the static frictional force between the first magnetic member 34 and the second magnetic member 42 and the static frictional force between the third magnetic member 35 and the fourth magnetic member 43 with the first engagement member 32 being engaged with the second engagement member 41 is smaller than the pressing force of the head pressing member 5. Thus, as depicted in FIG. 7B, when the thermal head 3 is at the printing position, the pressing force of the head pressing member 5 allows the thermal head 3 to pivot around the first axis L1 against the static frictional force between the first magnetic member 34 and the second magnetic member 42 and the static frictional force between the third magnetic member 35 and the fourth magnetic member 43. Accordingly, even when the placement direction of the printing apparatus 1 relative to the platen 19 is incorrect, the thermal head 3 at the printing position is positioned parallel to the extending surface of the platen 19. When the position of the thermal head 3 relative to the head holding member 4 is a position having pivoted from the reference position, the center position C1 of the first magnetic member 34 does not coincide with the center position C2 of the second magnetic member 42. Further, the center position C3 of the third magnetic member 35 does not coincide with the center position C4 of the fourth magnetic member 43.

In this embodiment, the head holding member 4 is configured such that the second engagement member 41, the second magnetic member 42, and the fourth magnetic member 43 are positioned on a first side and/or a second side in the left-right direction. The head holding member 4 holds the thermal head 3 such that the thermal head 3 can be removed from the head molding member 4 either on the right side or the left side of the head holding member 4. In the head holding member 4 of this embodiment, the second magnetic member 42 and the fourth magnetic member 43 are positioned on the first and second sides in the left-right direction by holding them by the head holding member 4 such that magnetic poles of the second magnetic member 42 and magnetic poles of the fourth magnetic member 43 are ends in the left-right direction and their ends in the left-right direction are exposed from the head holding member 4. The head holding member 4 of this embodiment removably holds the second engagement member 41.

Figure 9:
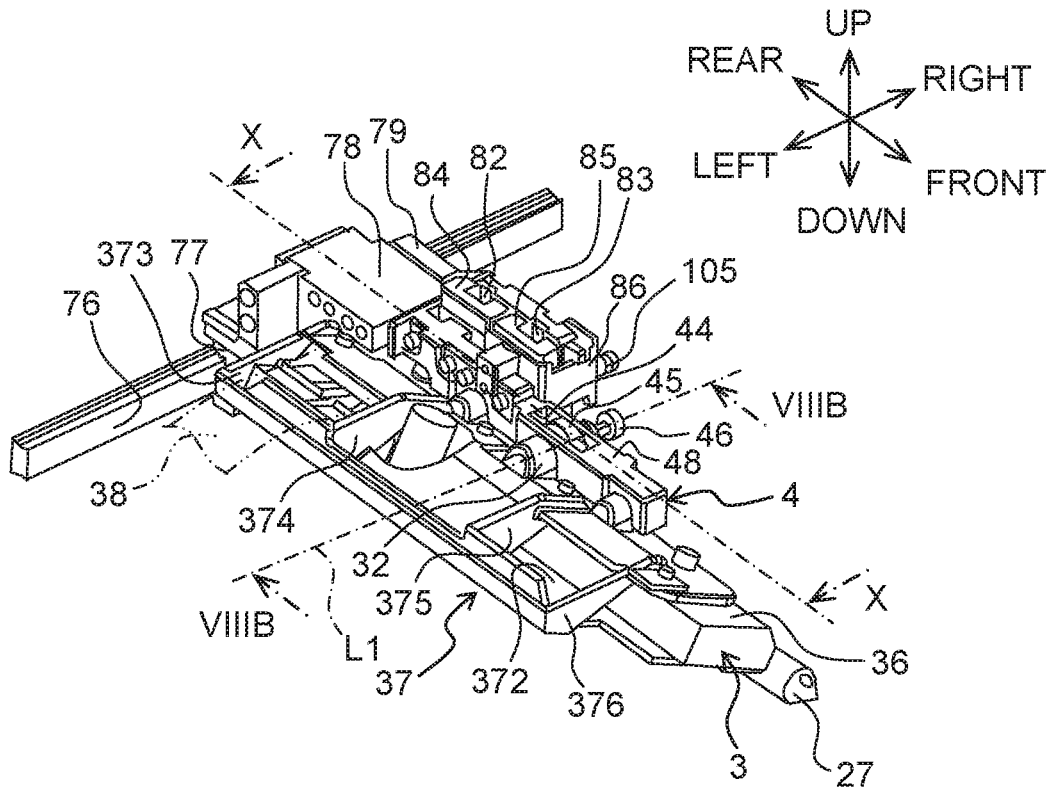
FIG. 9 is a perspective view of the thermal head 3 that is held by the head holding member 4 to have a second posture.

As depicted in FIGS. 8A to 8C, the head holding member 4 includes a holding part 69 that can position the engagement end 47 of the second engagement member 41 on the first side or second side in the left-right direction. Namely, the holding part 69 of the head holding member 4 is configured to change the position of the engagement end 47 of the second engagement member 41 based on whether the thermal head 3 is held on the first side or the second side in the left-right direction. The holding part 69 of this embodiment includes a hole 70 penetrating in the left-right direction. The bar-like second engagement member 41 is inserted into the hole 70 so that the center portion of the second engagement member 41 in the left-right direction is held. The center portion of the second engagement member 41 in the left-right direction has a diameter larger than those of other portions. Specifically, the head holding member 4 can hold the thermal head 3 such that the thermal head 3 has a first posture in which the head holding direction is the right side as depicted in FIG. 6 or a second posture in which the head holding direction is the left side as depicted in FIG. 9. When the thermal head 3 is held by the head holding member 4 to have the first posture, as depicted in FIG. 8A, the holding part 69 of the head holding member 4 holds the second engagement member 41 with the engagement end 47 of the second engagement member 41 positioned on the right side. In that situation, the flange 46 is positioned on the left side of the head holding member 4. When the thermal head 3 is held by the head holding member 4 to have the second posture, as depicted in FIG. 8B, the holding part 69 of the head holding member 4 holds the second engagement member 41 with the engagement end 47 of the second engagement member 41 positioned on the left side. In that situation, the flange 46 is positioned on the right side of the head holding member 4. In the both cases, the thermal head 3 is held by the head holding member 4 such that the upper surface of the ceramic substrate 36 is inclined to the first axis L1. As depicted in FIGS. 8A and 8B, the extending direction of the line L4 passing through the center of the rolling member 45 in the left-right direction and the position of the heating elements 31 in the left-right direction coincides with the up-down direction, both when the head holding direction is the right side and when the head holding direction is the left side.

The head holding direction is preferably determined by reflecting a printing method of the printing apparatus 1, a conveyance direction of the printing medium 8, and the like. For example, when the printing apparatus 1 performs printing while moving the thermal head 3 in the left-right direction during a period in which the conveyance of the printing medium 8 is stopped, the head holding direction preferably coincides with a moving direction of the thermal head 3. More specifically, for example, when the moving direction of the thermal head 3 during printing is a rightward direction, the head holding direction is preferably the right side. When the printing apparatus 1 performs printing without moving the thermal head 3 in the left-right direction during a period in which the printing medium 8 is conveyed, the head holding direction is preferably a side opposite to the conveyance direction of the printing medium 8 during printing. More specifically, when the conveyance direction of the printing medium 8 is a leftward direction, the head holding direction is preferably the right side.

The thermal head 3 is held by the head holding member 4 by the aid of the magnetic force between the first magnetic member 34 and the second magnetic member 42 and the magnetic force between the third magnetic member 35 and the fourth magnetic member 43. Thus, when replacing the thermal head 3 with another or when changing the head holding direction, the user can remove the thermal head 3 from the head holding member 4 by moving the thermal head 3 in a direction away from the head holding member 4. The user can replace the thermal head 3 with another by removing the harness 38 from the thermal head 3.

<Movement Assembly 30>

Figure 11:
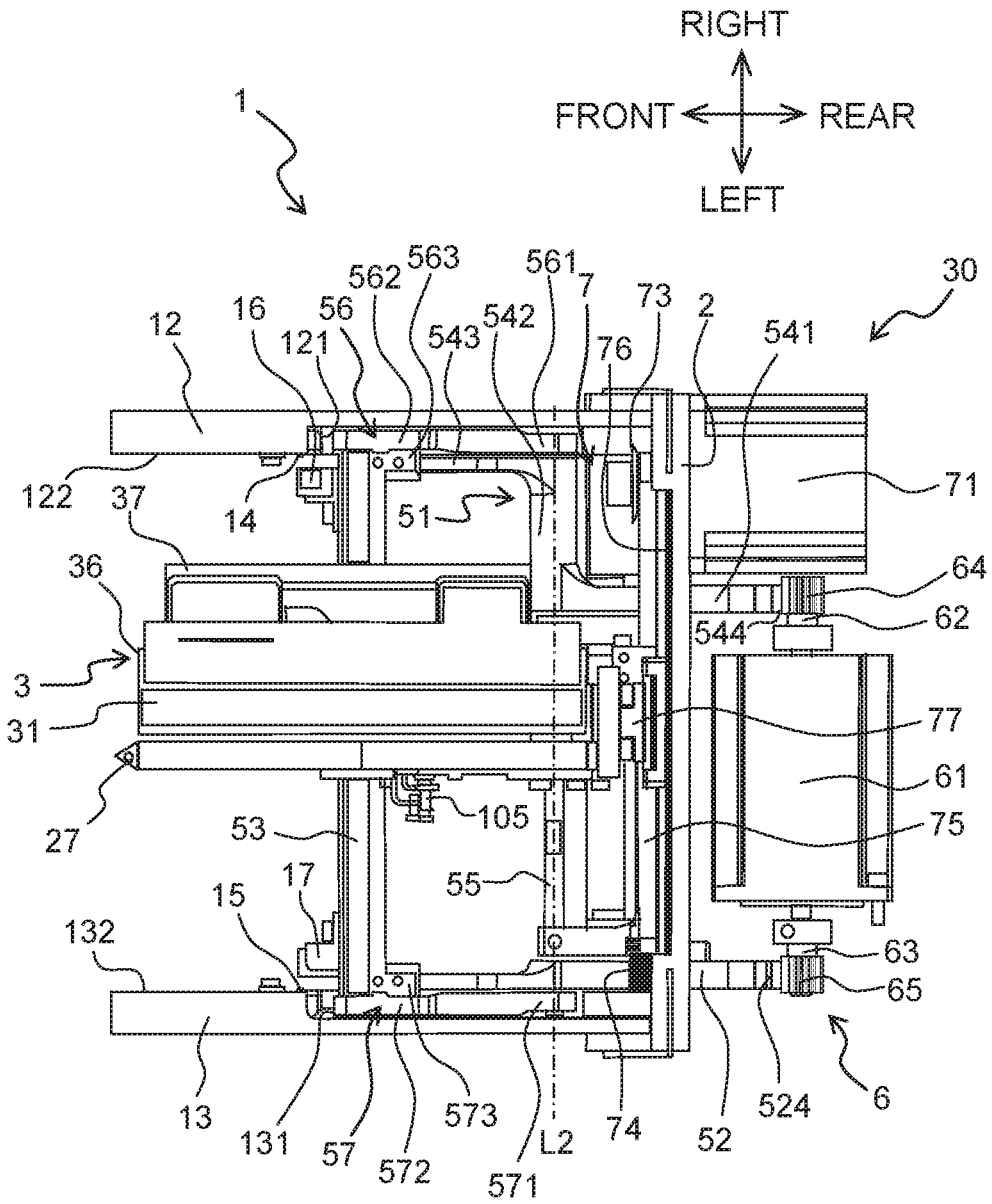
FIG. 11 is a bottom view of the printing apparatus 1 from which the cover 11 is removed.
Figure 12:
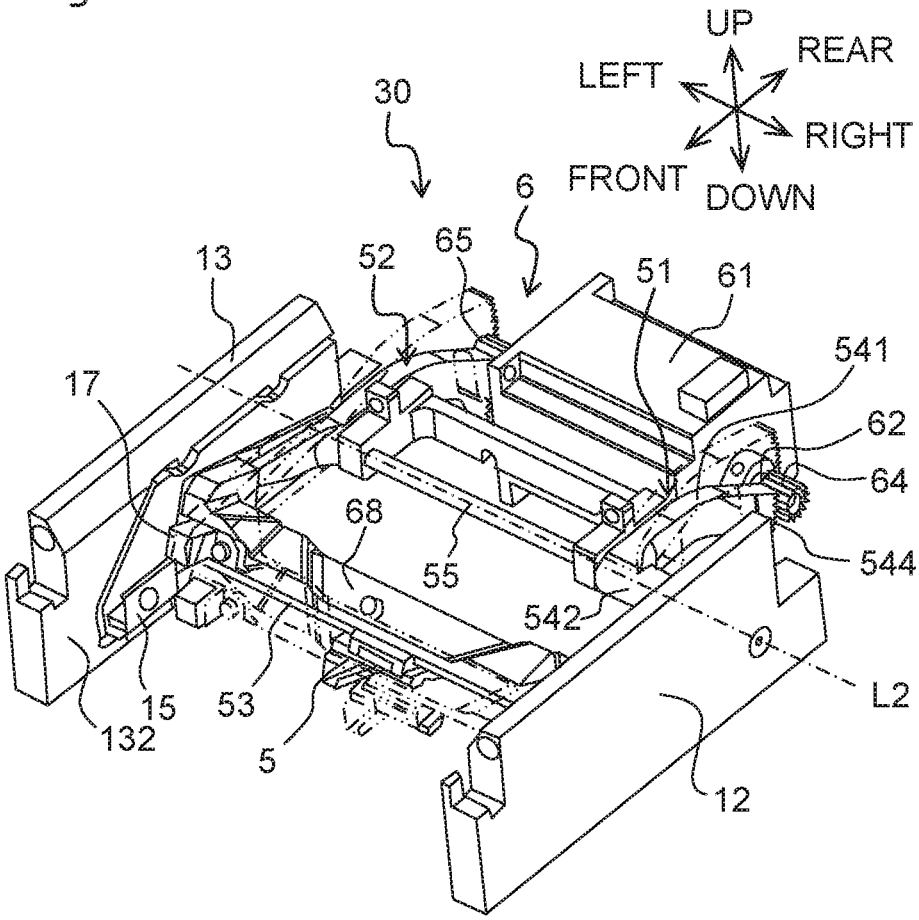
FIG. 12 is a perspective view of a movement assembly 30.

As depicted in FIGS. 11 and 12, the movement assembly 30 includes the head pressing member 5, a first movement mechanism 6, the first pivoting member 51, the second pivoting member 52, and a guide rail 53. The head pressing member 5 is disposed above the head holding member 4. The head pressing member 5 is pivotally supported by the base 2 around a second axis L2 extending in the left-right direction. The head pressing member 5 presses the head holding member 4 from above, that is, from a second side in the up-down direction. Specifically, the head pressing member 5 presses the rolling member 45 from above. The head pressing member 5 of this embodiment is held by the guide rail 53 to be slidable with respect to the base 2 in the left-right direction. The head pressing member 5 of this embodiment faces the thermal head 3 from above. As the head pressing member 5 and the guide rail 53, for example, a ready-made linear guide can be used. When using the linear guide, the head pressing member 5 is a table attached to the guide rail 53.

Figure 15:
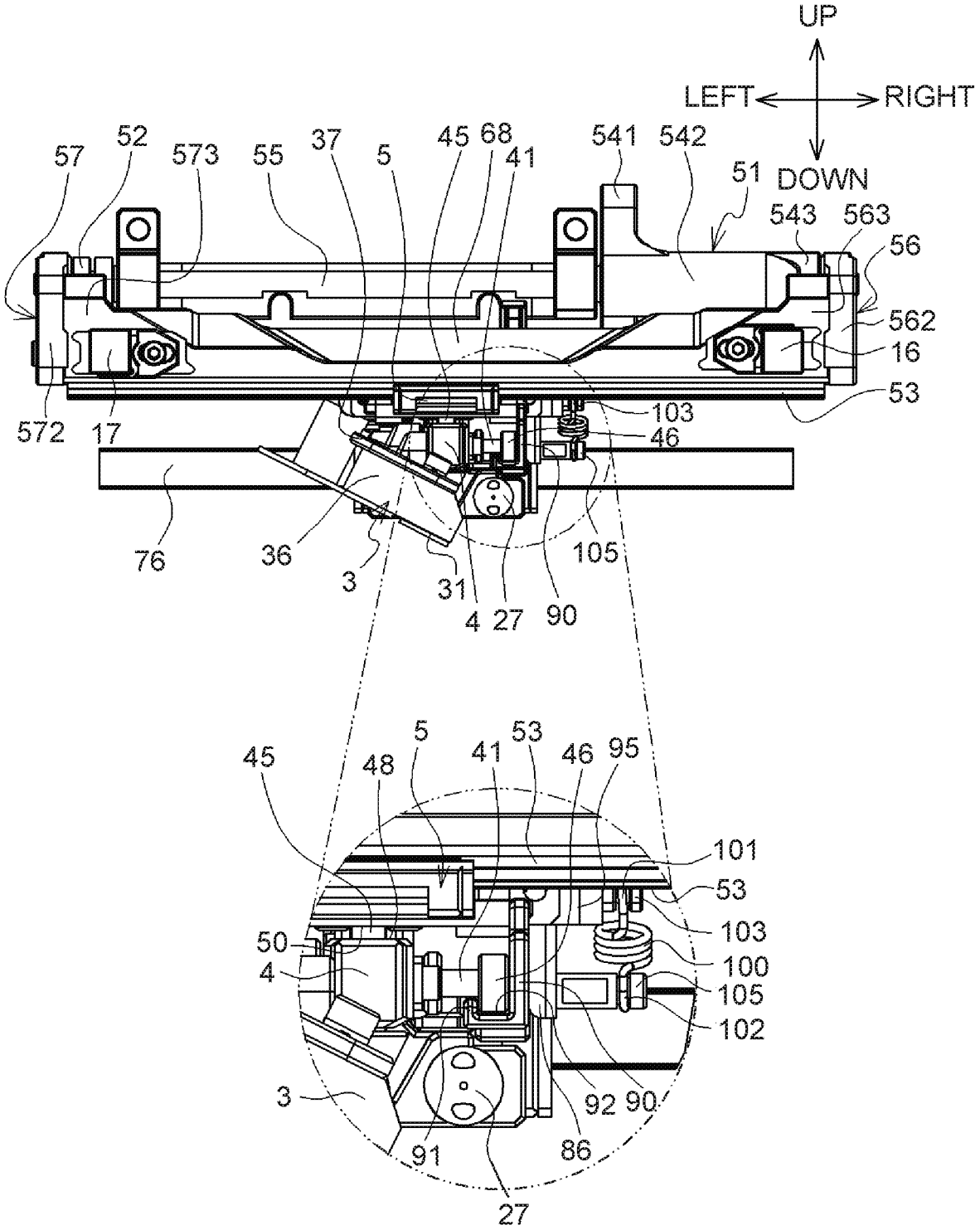
FIG. 15 is a front view of the thermal head 3 that is held by the head holding member 4 to have the second posture.
Figure 16:
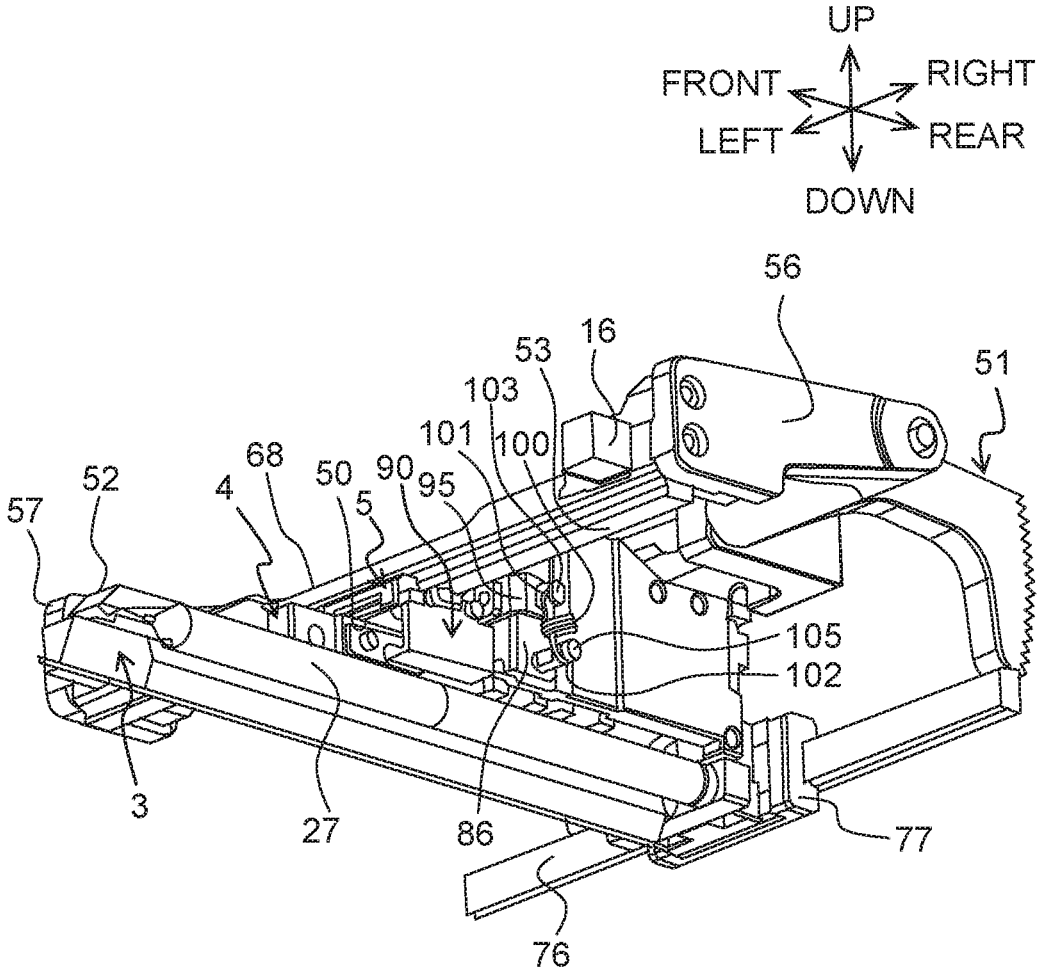
FIG. 16 is a perspective view of the thermal head 3 that is held by the head holding member 4 to have the second posture.

As depicted in FIGS. 15 and 16, the head pressing member 5 is connected to the coupling member 90. The coupling member 90 in this embodiment is removably connected to the head pressing member 5 by using, for example, a screw. The coupling member 90 is connected to the head pressing member 5 in a direction corresponding to the head holding direction. The direction in which the coupling member 90 is placed relative to the head pressing member 5 is the same as the head holding direction. The coupling member 90 includes a guide groove 92 with which the flange 46 of the second engagement member 41 engages. The guide groove 92 extending in the front-rear direction guides movement of the head holding member 4 in the front-rear direction. The guide groove 92 of this embodiment extends linearly and substantially in the front-rear direction. When the second engagement member 41 is engaged with the guide groove 92 of the coupling member 90 of this embodiment, the flange 46 is fitted into the guide groove 92 to make contact with a side wall 91 of the guide groove 92. The head pressing member 5 has the contact surface 50 that makes contact with the rolling member 45. The contact surface 50 is, for example, a flat surface. The contact surface 50 of this embodiment is the lower surface of the head pressing member 5. The contact surface 50 faces the head holding member 4.

A rear end of the head pressing member 5 is connected to a coupling member 95. The coupling member 95 includes a bar-like protrusion 103 protruding in the head holding direction. The coupling member 95 of this embodiment is connected removably to the head pressing member 5 by using, for example, a screw. The coupling member 95 is connected to the head pressing member 5 in a direction corresponding to the head holding direction.

As depicted in FIGS. 11 and 12, the first movement mechanism 6 includes a first motor 61, pinions 64 and 65, sector gears 544 and 524. The first movement mechanism 6 causes the first pivoting member 51 and the second pivoting member 52 to pivotally move around the second axis L2 extending in the left-right direction. The second axis L2 is on the front side of the base 2. As depicted in FIG. 10, the second axis L2 of this embodiment is at the substantially same position as the rear end of the attachment part 37 of the thermal head 3 in the front-rear direction. The second axis L2 is positioned above a rear end of the thermal head 3. The first motor 61 is disposed on the rear side of the base 2. The first motor 61 rotates a first output shaft 62 and a second output shaft 63. The first output shaft 62 is disposed on the rear side of the base 2 and extends rightward that is the first side in the left-right direction orthogonal to the front-rear direction. The second output shaft 63 extends leftward that is the second side in the left-right direction. The first motor 61 of this embodiment is a stepper motor. The pinion 64 is fixed to a front end of the first output shaft 62. The pinion 65 is fixed to a front end of the second output shaft 63. The pinions 64 and 65 have the same diameter. The rotation axes of the first output shaft 62, the second output shaft 63, the pinion 64, and the pinion 65 are on the same straight line. The sector gears 544 and 524 each have an arc-shape of which center is the second axis L2. The sector gear 544 is disposed at a rear end of the first pivoting member 51. The sector gear 524 is disposed at a rear end of the second pivoting member 52.

As depicted in FIGS. 11 and 12, the first pivoting member 51 extends from a position on the rear side of the base 2 to a position on the front side of the base 2. The first pivoting member 51 is supported by the base 2 to pivot around the second axis L2 parallel to the left-right direction. The first pivoting member 51 is inserted into the hole 18 of the base 2. The first pivoting member 51 includes a first part 541, a second part 542, and a third part 543. The sector gear 544 disposed at a rear end of the first part 541 is engaged with the first output shaft 62 of the first motor 61. The first part 541, which is positioned between the first motor 61 and the second motor 71 in the left-right direction, extends frontward beyond the base 2. The second part 542 extends rightward, which is the first side in the left-right direction, from a front end of the first part 541. The third part 543 extends frontward from a right end of the second part 542.

The second pivoting member 52 extends from a position on the rear side of the base 2 to a position on the front side of the base 2. The second pivoting member 52 is supported by the base 2 to pivot around the second axis L2. The second pivoting member 52 is inserted into a hole 88 of the base 2. The sector gear 524 disposed at the rear end of the second pivoting member 52 is engaged with the second output shaft 63 of the first motor 61. The second pivoting member 52 is disposed on the left side of the first pivoting member 51. The guide rail 53, which extends in the left-right direction, is connected to the front end of the first part 541 of the first pivoting member 51 and a front end of the second pivoting member 52. The front end of the first part 541 extends frontward beyond front ends of a first pulley 73, a second pulley 74, and a belt 75 which will be described later. The second part 542, which extends in the left-right direction, is disposed on the front side of the front ends of the first pulley 73, the second pulley 74, and the belt 75. The movement assembly 30 includes a bar-like shaft 55 having the second axis L2. The shaft 55 is inserted into the second part 542. Specifically, the second part 542 is provided with a through hole penetrating in the left-right direction, and the shaft 55 is inserted into the through hole. The first pillar 12 is disposed on the right side of the first pivoting member 51 to face the first pivoting member 51. The first pillar 12 supports a right end of the shaft 55. The second pillar 13 is disposed on the left side of the second pivoting member 52 to face the second pivoting member 52. The second pillar 13 supports a left end of the shaft 55. In this embodiment, the shaft 55 is fixed to the first pillar 12 and the second pillar 13 by using screws. The first pivoting member 51 and the second pivoting member 52 are supported by the shaft 55 via bearings. Namely, the first pivoting member 51 and the second pivoting member 52 are supported indirectly by the base 2 via the bearings, the shaft 55, the first pillar 12, and the second pillar 13.

The movement assembly 30 of this embodiment further includes a first connection member 56, a second connection member 57, and urging members 58 and 59. As depicted in FIGS. 11 and 13, the first connection member 56, which is disposed on the left side of the first pillar 12, is pivotally supported by the shaft 55 around the second axis L2 via a bearing. The first connection member 56 connects a first end 545 that is a front end of the third part 543 of the first pivoting member 51 and a right end of the guide rail 53 such that they are movable relative to each other (specifically, they can rotate relative to each other around the second axis L2). The first end 545 is a portion extending from a halfway point between the second axis L2 and the front end of the third part 543 to the front end of the third part 543. The first connection member 56 includes an insertion part 561, an arm 562, and a connection part 563. The shaft 55 is inserted into the insertion part 561 that is a rear end of the first connection member 56. The insertion part 561 is disposed on the right of the third part 543. The arm 562 extends frontward from the insertion part 561. The insertion part 561 and the arm 562 are placed in the recess 121 of the first pillar 12.

The connection part 563, which extends leftward, is connected to a front end of the arm 562. The connection part 563 has a U-shape or horseshoe shape when seen from the left side. The connection part 563 has an opening 564 that is open at the rear side. The first end 545 of the first pivoting member 51 is inserted into the opening 564. The connection part 563 is provided with bar-like members 565 protruding upward from a lower surface. The urging member 58 is wound around each bar-like member 565. The urging member 58 of this embodiment is a coil spring (e.g., a compression coil spring). A lower end of the urging member 58 is in contact with a lower end of the connection part 563. An upper end of the urging member 58 is in contact with the first end 545 of the first pivoting member 51 from below. The urging member 58 urges the first end 545 of the first pivoting member 51 inserted into the opening 564 upward. A lower surface of the arm 562 is connected to the right end of the guide rail 53.

A front surface of the first connection member 56 (connection part 563) is connected to the first detection member 16. The first sensor 14 is placed in the left surface 122 of the first pillar 12 facing the first connection member 56, at a position facing the first detection member 16 in a state where the guide rail 53 is positioned at a predefined position. The predefined position of this embodiment is a position on the lower side of the center of a movable range of the guide rail 53. Namely, the first sensor 14 is disposed on the lower side of a center M2 of a pivoting range R2 of the first detection member 16. The pivoting range R2 of the first detection member 16 is defined by a position P1 of the first detection member 16 when the first pivoting member 51 has moved to an upper end of the pivoting range and a position P2 of the first detection member 16 when the first pivoting member 51 has moved to a lower end of the pivoting range. The output of the first sensor 14 is used, for example, in processing for adjusting the pressing force to the platen 19 (the ink ribbon 9 and the printing medium 8) from the thermal head 3. The pressing force applied from the thermal head 3 to the platen 19 (the ink ribbon 9 and the printing medium 8) depends on lowering amounts of the pivoting members 51 and 52 after the thermal head 3 makes contact with the platen 19 via the ink ribbon 9 and the printing medium 8. The lowering amounts of the pivoting members 51 and 52 are controlled by a driving amount of the first motor 61. In order to accurately adjust the pressing force applied from the thermal head 3 to the platen 19 (the ink ribbon 9 and the printing medium 8), it is preferable that a position of the thermal head 3 in the vicinity of the platen 19 be detected accurately. In the printing apparatus 1, the distance between the first sensor 14 and the first detection member 16 when the thermal head 3 is positioned in the vicinity of the platen 19 in a state where the first sensor 14 is positioned on the lower side of the center M2 of the pivoting range R2 of the first detection member 16 is shorter than the distance between the first sensor 14 and the first detection member 16 when the thermal head 3 is positioned in the vicinity of the platen 19 in a state where the first sensor 14 is positioned on the upper side of the center M2. When the first sensor 14 is a magnetic sensor and the first detection member 16 is a magnet, magnetic field intensity detected by the first sensor 14 increases as the distance between the first sensor 14 and the first detection member 16 is shorter. This allows the position of the thermal head 3 in the up-down direction to be detected more accurately. Namely, the printing apparatus 1 of this embodiment can detect the position of the thermal head 3 in the vicinity of the platen 19 more accurately than a configuration in which the first sensor 14 is positioned on the upper side of the center M2 of the pivoting range R2 of the first detection member 16.

Figure 14:
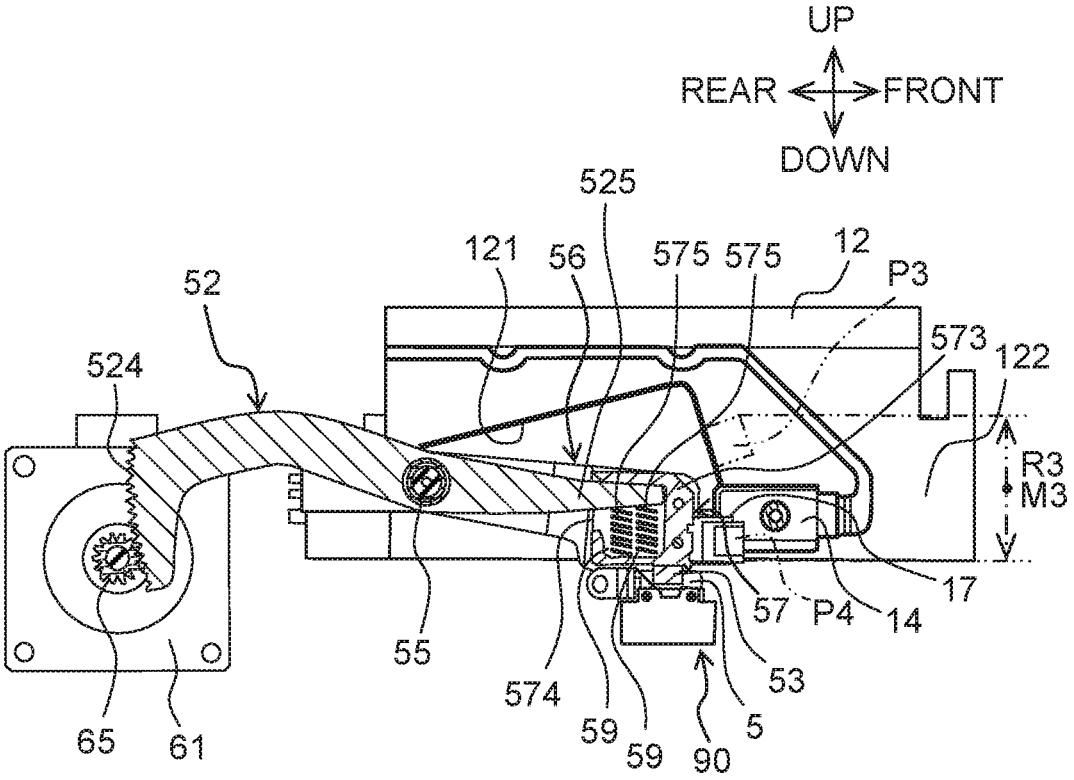
FIG. 14 is a cross-sectional view taken along an arrow XIV-XIV in FIG. 3.

Similarly to the first connection member 56, the second connection member 57, which is disposed on the right side of the second pillar 13, is pivotally supported by the shaft 55 around the second axis L2 via a bearing. The second connection member 57 connects a second end 525 that is the front end of the second pivoting member 52 and a left end of the guide rail 53 such that they are movable relative to each other. As depicted in FIGS. 11 and 14, the second connection member 57 includes an insertion part 571, an arm 572, and a connection part 573. The shaft 55 is inserted into the insertion part 571 that is a rear end of the second connection member 57. The insertion part 571 is disposed on the left side of the second pivoting member 52. The arm 572 extends frontward from the insertion part 571. The insertion part 571 and the arm 572 are placed in the recess 131 of the second pillar 13.

The connection part 573, which extends rightward, is connected to a front end of the arm 572. The connection part 573 has a U-shape or horseshoe shape when seen from the left side. The connection part 573 has an opening 574 that is open at the rear side. The second end 525 of the second pivoting member 52 is inserted into the opening 574. The connection part 573 is provided with bar-like members 575 protruding upward from a lower surface. The urging member 59 is wound around each bar-like member 575. The urging member 59 of this embodiment is a coil spring (e.g., a compression coil spring). A lower end of the urging member 59 is in contact with a lower end of the connection part 573. An upper end of the urging member 59 is in contact with a lower surface of the second end 525 of the second pivoting member 52. The urging member 59 urges the second end 525 of the second pivoting member 52 inserted into the opening 574 upward. A lower surface of the arm 572 is connected to the left end of the guide rail 53.

A front surface of the second connection member 57 (connection part 573) is connected to the second detection member 17. The second sensor 15 is disposed in a right surface of the second pillar 13 facing the second connection member 57, at a position facing the second detection member 17 in the state where the guide rail 53 is positioned at the predefined position. The second sensor 15 is positioned on the lower side of a center M3 of a pivoting range R3 of the second detection member 17. The pivoting range R3 of the second detection member 17 is defined by a position P3 of the second detection member 17 when the second pivoting member 52 has moved to an upper end of the pivoting range and a position P4 of the second detection member 17 when the second pivoting member 52 has moved to a lower end of the pivoting range. The connection part 563 and the connection part 573 of this embodiment configure a member 68 formed as one piece. The member 68 extends in the left-right direction. A right end of the member 68 is the connection part 563 and a left end of the member 68 is the connection part 573. The guide rail 53 is fixed to a lower surface of the member 68. The lower surface of the member 68 is a surface facing the head holding member 4. For example, similarly to the first sensor 14, the output of the second sensor 15 is used in processing for adjusting pressing force to the platen 19 (the ink ribbon 9 and the printing medium 8) from the thermal head 3. In this embodiment, the position of the second sensor 15 in the up-down direction is the same as the position of the first sensor 14 in the up-down direction. Since the printing apparatus 1 of this embodiment includes the first sensor 14 and the second sensor 15, output values of the first sensor 14 and the second sensor 15 can be used in processing for detecting an inclination of the guide rail 53 (the member 68) in the left-right direction.

As depicted in FIGS. 5, 6, 9, and 15, the movement assembly 30 further includes guide rails 82 and 83, sliding members 84 and 85, a plate member 86, and an urging member 100. The guide rails 82 and 83, which extend in the up-down direction, are fixed to a sliding member 77 described later. The sliding members 84 and 85 are held by the guide rails 82 and 83 to be slidable with respect to the base 2 in the up-down direction. The sliding members 84 and 85 are connected to the head holding member 4. The guide rails 82 and 83 are arranged with an interval in the front-rear direction. The movement assembly 30 of this embodiment includes two guide rails (i.e., the guide rails 82 and 83). The guide rails 82 and 83 of this embodiment are fixed to the sliding member 77 via coupling members 78 and 79. The coupling member 78, which has a square pole shape, is fixed to the front surface of the sliding member 77. The coupling member 79, which has a plate shape, is fixed to an attachment surface of the coupling member 78. The attachment surface of the coupling member 78 is one of the left and right surfaces of the coupling member 78 that is positioned in a direction opposite to the head holding direction. The coupling member 79 extends frontward beyond the coupling member 78 and includes rail placement grooves 80 and 81 extending in the up-down direction. The rail placement grooves 80 and 81 are grooves in which the guide rails 82 and 83 extending in the up-down direction are placed, respectively. The rail placement grooves 80 and 81 are arranged in the front-rear direction. The rail placement grooves 80 and 81 are provided in left and right surfaces of the coupling member 79, respectively. The guide rails 82 and 83 are attached to a surface of the coupling member 79 on a side facing the head holding member 4 by use of screws.

The sliding members 84 and 85 are held by the guide rails 82 and 83. The sliding member 84 and 85 respectively face the guide rails 82 and 83 in the left-right direction. The sliding member 84 disposed on the front side faces the fourth magnetic member 43 in the left-right direction. The plate member 86 is fixed to the sliding member 84 at a position between the sliding member 84 and the head holding member 4. The plate member 86 goes around the front side of the coupling member 79, turns or curves to the opposite side of the head holding direction, and extends rearward on the opposite side of the head holding direction in a state of being separated from the coupling member 79. The plate member 86 is provided with a protrusion 105 protruding in the direction opposite to the head holding direction. An end 101 of the urging member 100 of this embodiment is connected to the protrusion 103 of the head pressing member 5. The other end of the urging member 100 is connected to the protrusion 105 of the plate member 86 connected to the sliding member 77. The guide rails 82, 83 and the sliding members 84, 85 are positioned between the rolling member 45 and the guide rail 76 in the front-rear direction. In this embodiment, the head holding member 4 is connected to the sliding members 84 and 85 by use of screws, and it is disposed on the front side of the sliding member 77 without connected directly to the sliding member 77. Namely, the head holding member 4 is connected indirectly to the sliding member 77 via the sliding members 84 and 85, the guide rails 82 and 83, and the coupling members 78 and 79.

As depicted in FIG. 17A, when the thermal head 3 is positioned at the upper end of the movement range of the thermal head 3 in the up-down direction, the sliding members 84 and 85 are held by upper ends of the guide rails 82 and 83. In the up-down direction, an upper end of the plate member 86 coincides with an upper end of the coupling member 79. As depicted in FIG. 17B, when the thermal head 3 is disposed at a lower end of the moving range in the up-down direction, the sliding members 84 and 85 are held by lower ends of the guide rails 82 and 83. In the up-down direction, a lower end of the plate member 86 coincides with a lower end of the coupling member 79. Driving of the first movement mechanism 6 moves the head pressing member 5 in an arc of which center is the second axis L2. Thus, the inclination of the head pressing member 5 relative to the front-rear direction in FIG. 17A is different from that in FIG. 17B. Meanwhile, the thermal head 3, which is connected to the sliding members 84 and 85 guided by the guide rails 82 and 83, moves linearly in the up-down direction. Thus, the inclination of the head holding member 4 relative to the front-rear direction in FIG. 17A is substantially the same as that in FIG. 17B. In that configuration, when the head pressing member 5 moves arcuately, the contact position and the contact angle between the contact surface 50 of the head pressing member 5 and the rolling member 45 are changed. However, rolling the rolling member 45 on the contact surface 50 converts the arc movement of the head pressing member 5 into the up-down movement of the thermal head 3 via the rolling member 45.

When changing the head holding direction, the user removes, together with the second engagement member 41, the coupling member 79, the guide rails 82 and 83, the sliding members 84 and 85, and the plate member 86 from the coupling member 78 and the head holding member 4. Then, the user places them in positions depending on the head holding direction. The user removes the guide shaft 27 from the sliding member 77, and then places the guide shaft 27 in a position depending on the head holding direction. The guide shaft 27 is placed on the opposite side of the head holding direction relative to the head holding member 4. The user removes the coupling member 95 from the head pressing member 5, and then places it in a position on the opposite side of the head holding direction relative to the head pressing member 5.

<Second Movement Mechanism 7>

The second movement mechanism 7 includes the second motor 71. Driving the second motor 71 moves the head holding member 4 in the left-right direction. The second motor 71 includes a third output shaft 72 extending frontward that is the first side in the front-rear direction. As depicted in FIG. 4, the second motor 71 is disposed on the right side of the first motor 61 and on the rear side of the base 2. At least a part of the second motor 71 overlaps with the first motor 61 in the up-down direction perpendicular to the front-rear direction and the left-right direction. The second motor 71 of this embodiment is a stepper motor. The first motor 61 and the second motor 71 in this embodiment have substantially the same size in the up-down direction, and the length of the first motor 61 in the up-down direction is the same as the length of the second motor 71 in the up-down direction.

As depicted in FIG. 3, the second movement mechanism 7 includes the first pulley 73, the second pulley 74, and the belt 75. The first pulley 73 is connected to the third output shaft 72. The second pulley 74 is disposed on the left side of the first pulley 73. The belt 75, which is connected to the head holding member 4, is stretched between the first pulley 73 and the second pulley 74. The first pulley 73 and the second pulley 74 have substantially the same diameter. The center of the first pulley 73 is positioned on the left of the left surface 122 of the first pillar 12. The center of the second pulley 74 is positioned on the right of the right surface 132 of the second pillar 13. The belt 75 extends in the left-right direction. As depicted in FIG. 11, the guide rail 76, which extends in the left-right direction, is disposed on the front side of the base 2 and on the rear side of the second axis L2. The sliding member 77 is connected to a rear end of the head holding member 4. The sliding member 77 is held by the guide rail 76 to be slidable with respect to the base 2 in the left-right direction. The guide rail 76 faces the sliding member 77 in the front-rear direction. As the sliding member 77 and the guide rail 76, for example, a ready-made linear guide can be used. In that case, the sliding member 77 is a table attached to the guide rail 76.

<Electric Configuration of Printing Apparatus 1>

Figure 18:
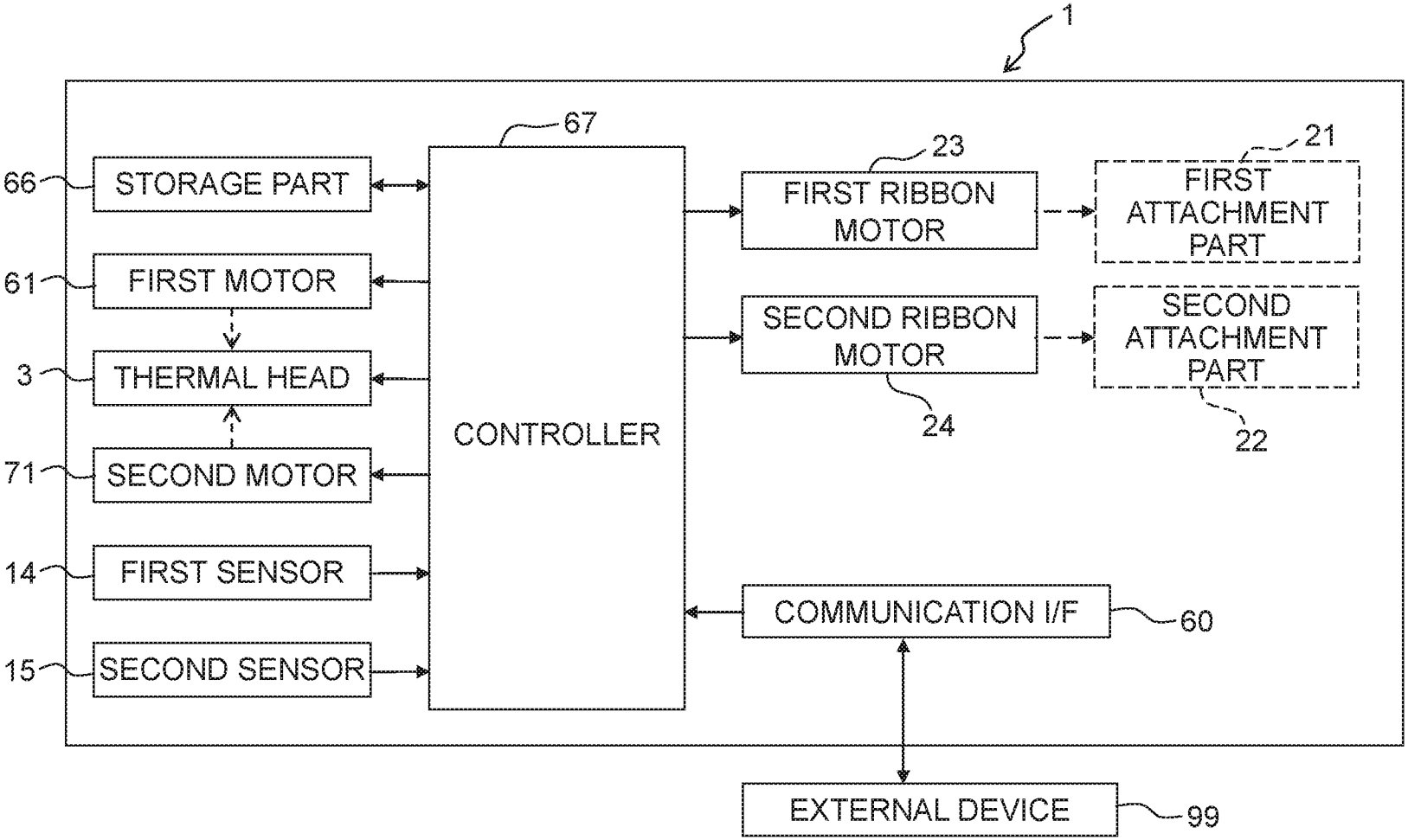
FIG. 18 is a block diagram depicting an electrical configuration of the printing apparatus 1.

Referring to FIG. 18, an electric configuration of the printing apparatus 1 will be explained. The printing apparatus 1 includes the controller 67, a storage part 66, the thermal head 3, the first motor 61, the second motor 71, the first sensor 14, the second sensor 15, a first ribbon motor 23, a second ribbon motor 24, and the communication interface (communication I/F) 60. The controller 67 includes a hardware processor (e.g., CPU) controlling the printing apparatus 1 and various driving circuits each operating in response to an instruction of the hardware processor. The various driving circuits include, for example, circuits supplying signals (e.g., driving current) to the first motor 61, the second motor 71, the first ribbon motor 23, and the second ribbon motor 24, a circuit supplying a signal (e.g., a driving current) to the thermal head 3, and a circuit driving the sensors 14, 15 and performing A/D conversion of an output signal received. The controller 67 is electrically connected to the storage part 66, the thermal head 3, the first motor 61, the second motor 71, the first sensor 14, the second sensor 15, the first ribbon motor 23, the second ribbon motor 24, and the communication I/D 60.

The storage part 66 includes various storage mediums such as ROM, RAM, and a flash memory. The storage part 66 stores a printing program including an instruction that causes the controller 67 to perform printing control processing described later. The storage part 66 further stores various setting values to drive the printing apparatus 1.

Each of the heating elements 31 of the thermal head 3 produces heat in response to a signal output from the controller 67. The first ribbon motor 23 rotates the first attachment part 21 in response to a pulse signal output from the controller 67. The second ribbon motor 24 rotates the second attachment part 22 in response to a pulse signal output from the controller 67. The first motor 61 rotates in response to a pulse signal output from the controller 67 to move the thermal head 3 between the printing position and the standby position and the retreat position (not depicted). The second motor 71 rotates in response to a pulse signal output from the controller 67 to move the thermal head 3 in the left-right direction. Each of the motors 23, 24, 61, and 71 is a stepper motor. Thus, the controller 67 controls each motor by controlling, for example, the number of steps to be transmitted to the motor.

The first sensor 14 outputs, to the controller 67, a signal corresponding to a position of the first detection member 16 in the up-down direction. The second sensor 15 outputs, to the controller 67, a signal corresponding to a position of the second detection member 17 in the up-down direction. Each of the first sensor 14 and the second sensor 15 is, for example, a non-contact magnetic sensor (e.g., a Hall element) that can output a signal depending on the change in magnetic flux density. Each of the first detection member 16 and the second detection member 17 is a permanent magnet.

<Outline of Print Processing by Printing Apparatus 1>

The storage part 66 stores a printing program including an instruction to perform print processing. After the start-up of the printing apparatus 1, the controller 67 performs the print processing by developing the printing program on the RAM of the storage part 66. In the print processing, printing is performed, for example, on condition that the conveyance of the printing medium 8 by use of the printing medium conveyance apparatus is performed periodically during a conveyance period. An external device 99 inputs a printing instruction to the printing apparatus 1 at timing at which the conveyance period ends. When receiving the printing instruction, the controller 67 starts the printing on the printing medium 8. Specifically, the controller 67 controls the first motor 61 to move the thermal head 3 from the standby position to the printing position.

The controller 67 detects that the thermal head 3 has reached a predefined position in the up-down direction based on the signals output from the first sensor 14 and the second sensor 15. The pivoting members 51 and 52 in this embodiment are configured to be asymmetric in the left-right direction, and the position of the thermal head 3 in the left-right direction depends on the printing position. Thus, the position of the thermal head 3 in the left-right direction may not be the center in the left-right direction. In that configuration, when the thermal head 3 is pressed by the head pressing member 5, the guide rail 53 is liable to inline in the left-right direction. The printing apparatus 1 may change the sensor to be used depending on the position of the thermal head 3 in the left-right direction. Namely, the printing apparatus 1 may detect the position of the thermal head 3 in the up-down direction based on the signal output from the first sensor 14 or the second sensor 15 positioned closer to the heating elements 31 of the thermal head 3. Accordingly, the printing apparatus 1 can accurately detect the position of the thermal head 3 in the up-down direction as compared to a case using a signal output from the same sensor irrespective of the position of the thermal head 3 in the left-right direction. The controller 67 controls the first motor 61 based on the signals output from the first sensor 14 and the second sensor 15 to adjust the pressing force applied from the thermal head 3 to the ink ribbon 9 and the printing medium 8.

The head pressing member 5 presses the rolling member 45 of the head holding member 4 downward along with driving of the first motor 61. The pressing force directed downward and received by the rolling member 45 is transmitted to the thermal head 3 via the curved surface 377. When the thermal head 3 is inclined to the surface of the platen 19, the pressing force of the head pressing member 5 allows the thermal head 3 to pivot around the first axis L1 against the static frictional force between the first magnetic member 34 and the second magnetic member 42 and the static frictional force between the third magnetic member 35 and the fourth magnetic member 43, as depicted in FIG. 7B. The thermal head 3 presses the ink ribbon 9 and the printing medium 8 downward in the front-rear direction with substantially uniform force.

The controller 67 controls the second motor 71 so that the thermal head 3 moves in the left-right direction at a predefined speed while making contact with the ink ribbon 9. At the same time, the controller 67 heats the heating elements 31 of the thermal head 3 based on printing data to transfer the ink of the ink ribbon 9 to a printing surface (an upper surface) of the printing medium 8. Upon completion of the printing, the controller 67 stops the heating of the thermal head 3 and controls the first motor 61 to move the thermal head 3 from the printing position to the standby position. When the thermal head 3 no longer receives the pressing force, which is applied from the head pressing member 5 to be directed downward, the thermal head 3 pivots around the first axis L1 due to the magnetic force between the first magnetic member 34 and the second magnetic member 42 and the magnetic force between the third magnetic member 35 and the fourth magnetic member 43. The position of the thermal head 3 relative to the head holding member 4 returns to the reference position where the center position C1 of the first magnetic member 34 coincides with the center position C2 of the second magnetic member 42 and the center position C3 of the third magnetic member 35 coincides with the center position C4 of the fourth magnetic member 43, as depicted in FIG. 7A. Before start of the next printing, the printing apparatus 1 controls the first ribbon motor 23 and the second ribbon motor 24 to convey the ink ribbon 9 and controls the second motor 71 to move the thermal head 3 in the left-right direction, as needed.

The printing apparatus 1 may perform the print processing during the conveyance of the printing medium 8 without moving the thermal head 3 in the left-right direction. In that case, the platen 19 is preferably a roller-shaped platen. The external device 99 inputs a printing instruction to the printing apparatus 1 at predefined timing. The controller 67 starts printing on the printing medium 8 when receiving the printing instruction. In particular, the controller 67 controls the first motor 61 to move the thermal head 3 from the standby position to the printing position. The controller 67 detects that the thermal head 3 has reached the predefined position in the up-down direction based on the signals output from the first sensor 14 and the second sensor 15. The controller 67 adjusts the pressing force to be applied from the thermal head 3 to the ink ribbon 9 and the printing medium 8 by controlling the first motor 61 based on the signals output from the first sensor 14 and the second sensor 15.

The controller 67 controls the first ribbon motor 23 and the second ribbon motor 24 to convey the ink ribbon 9 making contact with the thermal head 3 in a direction that is the same as the conveyance direction of the printing medium 8. In that situation, the conveyance speed of the ink ribbon 9 is the same as the conveyance speed of the printing medium 8 or slightly slower than the conveyance speed of the printing medium 8. The conveyance speed of the printing medium 8 may be obtained, for example, from the external device 99 or may be detected by using a sensor or the like. At the same time, the controller 67 heats the heating elements 31 of the thermal head 3 based on printing data and transfers the ink of the ink ribbon 9 to the printing surface (the upper surface) of the printing medium 8. Upon completion of the printing, the controller 67 stops the heating of the thermal head 3 and the conveyance of the ink ribbon 9, and then controls the first motor 61 to move the thermal head 3 from the printing position to the standby position.

In the printing apparatus 1 of this embodiment, the thermal head 3 can be held by the head holding member 4 by engaging the first engagement member 32 with the second engagement member 41. The position of the thermal head 3 relative to the head holding member 4 can change depending on the magnetic force between the first magnetic member 34 and the second magnetic member 42 and the force to be applied from the head pressing member 5 to the thermal head 3. For example, even when the printing apparatus 1 is placed in a state of being inclined to the surface of the platen 19, if the head holding member 4 holding the thermal head 3 is at the standby position separated from the printing position and the head pressing member 5 applies no pressing force to the thermal head 3, as depicted in FIG. 7A, the position of the thermal head 3 relative to the head holding member 4 is the reference position where the first magnetic member 34 faces the second magnetic member 42 to have the strongest magnetic force therebetween. As depicted in FIG. 7B, when the head holding member 4 holding the thermal head 3 is at the printing position and the head pressing member 5 presses the thermal head 3 toward the ink ribbon 9, the pressing force may cause the thermal head 3 to move away from the reference position and to pivot around the first axis L1 relative to the head holding member 4. Therefore, in the printing apparatus 1 of this embodiment, the pressing force can be uniformly applied from the thermal head 3 to the ink ribbon 9 in the front-rear direction, and when no pressing force is applied from the head pressing member 5 to the thermal head 3, the thermal head 3 is positioned at the reference position due to the magnetic force between the first magnetic member 34 and the second magnetic member 42. This reduce the possibility of inclination of the thermal head 3 relative to the conveyance path P of the ink ribbon 9.

As depicted in FIG. 7A, the center position C1 of the first magnetic member 34 substantially coincides in the up-down direction with the center position L1 of the first engagement member 32 (the engagement hole 33) with the first engagement member 32 (the engagement hole 33) being engaged with the second engagement member 41. In the up-down direction, the center position C2 of the second magnetic member 42 substantially coincides with the center position L1 of the second engagement member 41. Thus, the printing apparatus 1 can downsize the thermal head 3 and the head holding member 4 in the up-down direction, as compared to a configuration where the respective center positions do not coincide with each other in the up-down direction.

The printing apparatus 1 includes the third magnetic member 35 and the fourth magnetic member 43. The third magnetic member 35 is provided in the thermal head 3. The third magnetic member 35 is positioned on the rear side of the first engagement member 32 when the head holding direction is the right side as depicted in FIG. 8C. The fourth magnetic member 43, which is provided in the head holding member 4, is positioned on the rear side of the second engagement member 41. When the first engagement member 32 is engaged with the second engagement member 41 and the first magnetic member 34 faces the second magnetic member 42 in the left-right direction, the fourth magnetic member 43 faces the third magnetic member 35 in the left-right direction so that they are attracted to each other by magnetic force. Thus, in the printing apparatus 1 of this embodiment, the head holding member 4 can stably hold the thermal head 3 by strong magnetic force as compared to a printing apparatus including the first magnetic member 34 and the second magnetic member 42 only. The head holding member 4 of the printing apparatus 1 can hold the thermal head 3 by the magnetic force of the magnetic members at both sides, in the front-rear direction, of the position where the first engagement member 32 is engaged with the second engagement member 41.

As depicted in FIG. 5, the third magnetic member 35 and the first magnetic member 34 are positioned symmetrically with respect to the virtual surface F including the first axis L1 and extending in the up-down direction. The fourth magnetic member 43 and the second magnetic member 42 are positioned symmetrically with respect to the virtual surface F. The printing apparatus 1 of this embodiment is not likely to cause deviation of the center of gravity of each of the thermal head 3 and the head holding member 4 relative to the virtual F and thus has a good balance in the front-rear direction, as compared to a configuration where the magnetic members are not positioned symmetrically with respect to the virtual surface F.

The first magnetic member 34, the second magnetic member 42, the third magnetic member 35, and the fourth magnetic member 43 are the permanent magnets. As depicted in FIG. 8C, when the first engagement member 32 is engaged with the second engagement member 41, the first magnetic member 34 faces the second magnetic member 42 such that mutually different magnetic poles face each other in the left-right direction. The third magnetic member 35 faces the fourth magnetic member 43 such that mutually different magnetic poles face each other in the left-right direction. Thus, the head holding member 4 of the printing apparatus 1 of this embodiment can hold the thermal head 3 by stronger magnetic force than a printing apparatus in which only one of the first magnetic member 34 and the second magnetic member 42 is the permanent magnet and a printing apparatus in which only one of the third magnetic member 35 and the fourth magnetic member 43 is the permanent magnet.

As depicted in FIGS. 8A to 8C, the head holding member 4 is configured such that the second engagement member 41, the second magnetic member 42, and the fourth magnetic member 43 are positioned on the first side and/or the second side in the left-right direction. The head holding member 4 holds the thermal head 3 such that the thermal head 3 can be removed from the head molding member 4 either on the right or the left side of the head holding member 4. Thus, in the printing apparatus 1, the thermal head 3 can be held by the head holding member 4 such that the thermal head 3 can be removed from the head holding member 4 either on the right side or the left side of the head holding member 4. This helps the user change the head holding direction depending on a printing condition such as the conveyance direction of the printing medium 8.

As depicted in FIGS. 8A to 8C, the first end of the second engagement member 41 is different in shape from the second end of the second engagement member 41. The first end of the second engagement member 41, which is the engagement end 47, engages with the first engagement member 32.

The head holding member 4 includes the holding part 69 that can position the engagement end 47 of the second engagement member 41 on the first side or the second side in the left-right direction. The second magnetic member 42 and the fourth magnetic member 43 are held by the head holding member 4 such that magnetic poles of the second magnetic member 42 and magnetic poles of the fourth magnetic member 43 are ends in the left-right direction and their ends in the left-right direction are exposed from the head holding member 4. The magnetic polarity of the second magnetic member 42 in the head holding direction (the right side or the left side) is different from the magnetic polarity of the fourth magnetic member 43 in the head holding direction (the right side or the left side). The magnetic polarity of the first magnetic member 34 on the side facing the head holding member is different from the magnetic polarity of the third magnetic member 35 on the side facing the head holding member. Since the head holding member 4 of the printing apparatus 1 has a relatively simple configuration described above, the head holding member 4 can removably hold the thermal head 3 either on the right side or the left side of the head holding member 4. This helps the user change the head holding direction depending on the printing condition such as the conveyance direction of the printing medium 8.

The second engagement member 41 is the shaft having the first axis L1. The first engagement member 32 has the engagement hole 33 into which the second engagement member 41, which is the shaft, is removably inserted. Each of the first engagement member 32 and the second engagement member 41 of the printing apparatus 1 can have a relatively simple configuration. In the printing apparatus 1, the user can engage the first engagement member 32 with the second engagement member 41 through an easy procedure in which the second engagement member 41 is inserted into the engagement hole 33 of the first engagement member 32. When removing the thermal head 3 from the head holding member 4, the user is only required to separate the head holding member 4 from the thermal head 3 in the left-right direction against the magnetic force between the magnetic members, which eliminates the necessity of removal of a fixing piece such as the spring.

The second engagement member 41 that is the shaft is inserted into the head holding member 4. The head holding member 4 includes the rolling member 45 protruding beyond the upper surface 48 of the head holding member 4 and rotatable around the first axis L1. The head pressing member 5 presses the rolling member 45 from above. The printing apparatus 1 can transmit the pressing force directed downward to the thermal head 3 via the rolling member 45 and the second engagement member 41.

The rolling member 45 protrudes beyond the lower surface 49 of the head holding member 4. The thermal head 3 has the curved surface 377. When the first engagement member 32 is engaged with the second engagement member 41, the curved surface 377 is positioned below the head holding member 4. The curved surface 377 curves in the front-rear direction depending on the outer circumference of the rolling member 45. The curved surface 377 receives the rolling member 45 from the lower side. Thus, in the printing apparatus 1, the curved surface 377 of the thermal head 3 can stably receive the pressing force transmitted from the head pressing member 5 via the rolling member 45.

The heating elements 31 are arranged along the edge of the thermal head 3 extending in the front-rear direction in a state of facing the lower side. As depicted in FIGS. 8A and 8B, the extending direction of the line L4 passing through the center of the rolling member 45 in the left-right direction and the position of the heating elements 31 in the left-right direction coincides with the up-down direction. The printing apparatus 1 is provided with the heating elements 31 that are arranged along the edge of the ceramic substrate 36, thus reducing heat accumulation to achieve good thermal responsiveness. In the printing apparatus 1, the pressing force transmitted from the head pressing member 5 is effectively transmitted to the heating elements 31 arranged in the edge, and the pressing force is applied uniformly from the thermal head 3 to the ink ribbon 9 in the front-rear direction.

The sum of the static frictional force between the first magnetic member 34 and the second magnetic member 42 and the static frictional force between the third magnetic member 35 and the fourth magnetic member 43 with the first engagement member 32 being engaged with the second engagement member 41 is smaller than the pressing force of the head pressing member 5. Thus, the pressing force of the head pressing member 5 allows the thermal head 3 of the printing apparatus 1 to pivot around the first axis L1 relative to the head holding member 4 (base 2) against the static frictional force between the magnetic members.

The sum of the moment around the first axis L1 due to the static frictional force between the first magnetic member 34 and the second magnetic member 42 and the moment around the first axis L1 due to the static frictional force between the third magnetic member 35 and the fourth magnetic member 43 is larger than the moment around the first axis L1 due to the gravity and external force received by the thermal head 3. When the thermal head 3 of the printing apparatus 1 is not pressed by the head pressing member 5, the head holding member 4 can hold the thermal head 3 at the reference position depicted in FIG. 7A.

The harness 38 is attached to the thermal head 3 at the position separated from the first engagement member 32 in the front-rear direction. The external force received by the thermal head 3 includes the pressing force from the harness 38. Even when the influence of the harness 38 attached to the thermal head 3 is included, the head holding member 4 of the printing apparatus 1 can hold, at the reference position, the thermal head 3 that is not subjected to the pressing force.

The printing apparatus of the present disclosure is not limited to the above embodiment, and may be appropriately changed within a range without changing the gist or essential characteristics of the present disclosure. For example, the following modifications may be added to the printing apparatus of the present disclosure as appropriate.

The configuration of the printing apparatus 1 may be changed appropriately. The first direction, the second direction, and the third direction of the printing apparatus 1 may be changed appropriately. The first direction, the second direction, and the third direction are only required to intersect with each other, namely, they may not be orthogonal or perpendicular to each other. The printing apparatus 1 may include the printing medium conveyance apparatus that conveys the printing medium 8. The configuration of the printing medium 8 and the ink ribbon 9 may be changed appropriately. Driving sources moving the respective members may be changed appropriately. The conveyance path P of the ink ribbon 9 of the printing apparatus 1 may be changed appropriately. The configuration of the first pivoting member 51 and the second pivoting member 52 may be changed appropriately. The first pivoting member 51 may not include the first part 541, the second part 542, and the third part 543. The printing apparatus 1 may not include a part or all of the components of the ribbon conveyance mechanism 20. A first part, a second part, and a third part that are similar to those of the first pivoting member 51 may be provided in at least one of the first pivoting member 51 and the second pivoting member 52. An apparatus conveying the ink ribbon may be provided independently of the printing apparatus 1. The printing apparatus 1 may include the platen 19. The platen 19 may have a plate shape or a roller shape. The base 2 may not be a member in a flat plate shape. The base may be a member of which surface has a concavity and a convexity or a member of which surface is curved. The base may have a box shape. The configuration of the movement assembly 30 and the second movement mechanism 7 may be changed appropriately. The movement assembly 30 may be a configuration with a fork assembly described in U.S. Pat. No. 8,937,634 specification. The printing apparatus 1 may omit the second movement mechanism 7 as needed.

In the up-down direction, the center position of the first magnetic member 34 may not coincide with the center position of the first engagement member 32 with the first engagement member 32 being engaged with the second engagement member 41. In the up-down direction, the center position of the second magnetic member 42 may not coincide with the center position of the second engagement member 41. The printing apparatus 1 may not include the third magnetic member 35 and the fourth magnetic member 43. More than three pairs of the magnetic members may be provided in the printing apparatus 1. The third magnetic member 35 and the first magnetic member 34 may not be positioned symmetrically with respect to the virtual surface F. The fourth magnetic member 43 and the second magnetic member 42 may not be positioned symmetrically with respect to the virtual surface F.

One of the first magnetic member 34 and the second magnetic member 35 may be a permanent magnet, and the other of the first magnetic member 34 and the second magnetic member 35 may be a ferromagnetic body such as stainless. Similarly, one of the third magnetic member 35 and the fourth magnetic member 43 may be a permanent magnet, and the other of the third magnetic member 35 and the fourth magnetic member 43 may be a ferromagnetic body. In the head holding member 4, the second engagement member 41, the second magnetic member 42, and the fourth magnetic member 43 may not be arranged on the first side and/or the second side in the left-right direction. In the head holding member 4, the second magnetic member 42 and the fourth magnetic member 43 may be removable members and they may be positioned on the first side or the second side in the left-right direction. The first end and the second end of the second engagement member 41 in the left-right direction may have the same shape. The first end and the second end of the second engagement member 41 may be engaged with the first engagement member 32. In that configuration, the head holding member 4 may have a configuration in which the second engagement member 41 is positioned on the first and second sides in the left-right direction or a configuration in which the second engagement member 41 is not positioned on the first side and/or the second side in the left-right direction. The size, the shape, and the like of each magnetic member may be changed appropriately. Each magnetic member may appropriately include a yoke increasing magnetic flux density. The head holding member 4 may hold the thermal head 3 such that the thermal head 3 can be removed from the head holding member 4 on only one of the right side and the left side of the head holding member 4.

The shape of the first engagement member 32 and the shape of the second engagement member 41 may be changed appropriately. For example, the first engagement member 32 may be a protrusion and the second engagement member 41 may be a member having an engagement hole into which the protrusion fits. The shape of the protrusion may be changed appropriately. The second engagement member 41 may not be the shaft having the first axis L1. The second magnetic member 42 and the fourth magnetic member 43 may not be held by the head holding member 4 in the way such that magnetic poles of the second magnetic member 42 and magnetic poles of the fourth magnetic member 43 are ends in the left-right direction and their ends in the left-right direction are exposed from the head holding member 4. The second magnetic member 42 and the fourth magnetic member 43 may be a permanent magnet constructed from one piece. In that case, for example, the second magnetic member 42 corresponds to an end, of the permanent magnet in a U-shape or horseshoe shape when seen from above, having one of the magnetic poles and the fourth magnetic member 43 corresponds to an end of the permanent magnet having the other of the magnetic poles. The permanent magnet is only required to be held by the head holding member 4 such that both ends of the permanent magnet are positioned in the head holding direction. When the second magnetic member 42 and the fourth magnetic member 43 are the ferromagnetic bodies made of metal such as stainless, the second magnetic member 42 and the fourth magnetic member 43 may be a member constructed from one piece. Similarly, the first magnetic member 34 and the third magnetic member 35 may be a member constructed from one piece. The second magnetic member 42 and the fourth magnetic member 43 may have the same magnetic polarity on the first side in the left-right direction. The first magnetic member 34 and the third magnetic member 35 may have the same magnetic polarity on the side facing the head holding member 4.

The head holding member 4 may not include the rolling member 45. The head pressing member 5 may not press the rolling member 45 from the second side in the up-down direction. The rolling member 45 may not protrude beyond at least one of the upper surface 48 and the lower surface 49 of the head holding member 4. The thermal head 3 may not include the curved surface 377. A flat surface of the thermal head 3 may make contact with the rolling member 45. The arrangement of the heating elements 31 may be changed appropriately. The heating elements 31 may not be arranged along the edge extending in the front-rear direction in a state of facing the first side in the up-down direction. The extending direction of the third line connecting the center of the rolling member 45 in the left-right direction and the position of the heating elements 31 in the left-right direction may not coincide with the up-down direction. The external force received by the thermal head 3 may include any other force than the pressing force from the harness 38 or may not include the pressing force from the harness 38.

Figure 19:
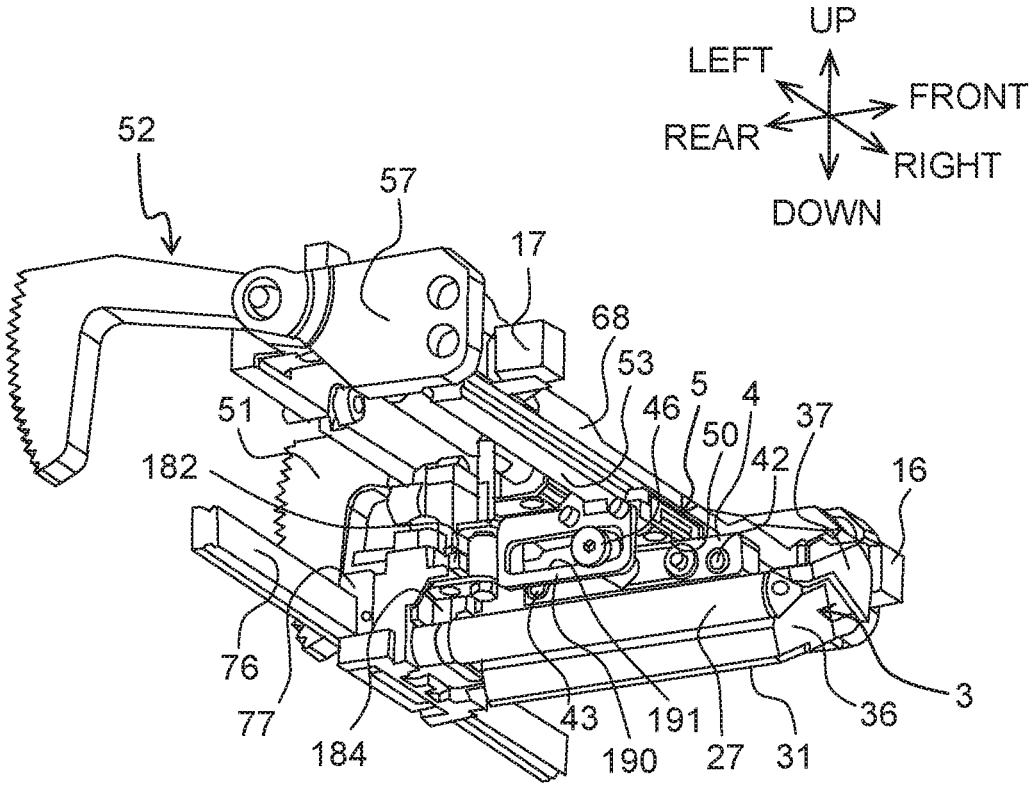
FIG. 19 is a perspective view of the thermal head 3 and the head holding member 4 of a printing apparatus according to a modified embodiment.

The printing apparatus 1 may have a configuration of a modified embodiment depicted in FIG. 19 instead of the configuration depicted in FIG. 17. In FIG. 19, the components or parts which are basically the same as those of the embodiment depicted in FIG. 17 are designated by the same reference numerals. A thermal head 3 of the modified embodiment depicted in FIG. 19 has a length in the front-rear direction (e.g., about 5 cm) that is shorter than the length of the thermal head 3 in the front-rear direction (e.g., about 13 cm) of the embodiment depicted in FIG. 17. As depicted in FIG. 19, a coupling member 190, a guide rail 182, and a sliding member 184 are configured differently from those of the embodiment depicted in FIG. 17. Explanation of the components that are configured similarly to those of the embodiment depicted in FIG. 17 will be omitted, and the coupling member 190, the guide rail 182, and the sliding member 184 will be explained below. The coupling member 190 has a plate shape extending along a surface that includes the front-rear direction and the up-down direction. An upper front end of the coupling member 190 is fixed to the head pressing member 5 with a screw. The coupling member 190 has a long hole 191. A longitudinal direction of the long hole 191 is the front-rear direction, and a lateral direction of the long hole 191 is the up-down direction. The long hole 191 extends linearly in the longitudinal direction. The long hole 191 penetrates in the left-right direction. The second engagement member 41 having the shaft shape is inserted into the long hole 191 with the flange 46 positioned at the second end of the second engagement member 41 being positioned on the right side. The direction in which the flange 46 is positioned relative to the coupling member 190 coincides with the direction in which the coupling member 190 is positioned relative to the head pressing member 5. The diameter of the flange 46 is longer than the length of the long hole 191 in the lateral direction. Thus, when the head holding member 4 moves in the left-right direction, the engagement between the second engagement member 41 and the coupling member 190 is not released.

The guide rail 182 extending in the up-down direction is connected to the front surface of the sliding member 77. The sliding member 184 is held by the guide rail 182 to be slidable with respect to the base 2 in the up-down direction. The sliding member 184 is connected to the rear end of the head holding member 4. The guide rail 182 faces the sliding member 184 in the front-rear direction. In the modified embodiment, the single guide rail 182 is connected to the sliding member 77. The single sliding member 184 is connected to the head holding member 4. In the modified embodiment, when changing the head holding direction, the user does not need to change the placement positions of the guide rail 182 and the sliding member 184 together with the second engagement member 41.

What is claimed is:

1. A printing apparatus, comprising:

a base;

a thermal head including heating elements arranged in a first direction;

a first engagement member provided in the thermal head;

a second engagement member facing the first engagement member in a second direction intersecting with the first direction and configured to engage with the first engagement member such that the thermal head pivotally moves, relative to the base, around a first axis extending in the second direction;

a head holding member having the second engagement member, being slidable with respect to the base in a third direction intersecting with the first direction and the second direction, and holding the thermal head such that the heating elements face the third direction, a first magnetic member provided in the thermal head and positioned on a first side in the first direction relative to the first engagement member;

a second magnetic member provided in the head holding member, positioned on the first side in the first direction relative to the second engagement member, and facing the first magnetic member in the second direction so that the first magnetic member and the second magnetic member are attracted to each other by magnetic force, in a case that the first engagement member is engaged with the second engagement member; and a head pressing member supported by the base to pivotally move around a second axis extending in the second direction and configured to face the head holding member from a first side in the third direction.

2. The printing apparatus according to claim 1, wherein a center position of the first magnetic member in the third direction coincides with a center position of the first engagement member in the third direction in the case that the first engagement member is engaged with the second engagement member, and a center position of the second magnetic member in the third direction coincides with a center position of the second engagement member in the third direction.

3. The printing apparatus according to claim 1, further comprising:

a third magnetic member provided in the thermal head and positioned on a second side in the first direction relative to the first engagement member; and a fourth magnetic member provided in the head holding member, positioned on the second side in the first direction relative to the second engagement member, and facing the third magnetic member in the second direction so that the fourth magnetic member and the third magnetic member are attracted to each other by magnetic force, in the case that the first engagement member is engaged with the second engagement member and that the first magnetic member faces the second magnetic member in the second direction.

4. The printing apparatus according to claim 3, wherein the third magnetic member and the first magnetic member are positioned symmetrically with respect to a virtual plane including the first axis and extending in the third direction, and the fourth magnetic member and the second magnetic member are positioned symmetrically with respect to the virtual plane.

5. The printing apparatus according to claim 3, wherein each of the first magnetic member, the second magnetic member, the third magnetic member, and the fourth magnetic member is a permanent magnet, and in the case that the first engagement member is engaged with the second engagement member, the first magnetic member faces the second magnetic member such that a magnetic pole of the first magnetic member in the second direction faces a magnetic pole of the second magnetic member in the second direction, the magnetic poles being different from each other in polarity, and the third magnetic member faces the fourth magnetic member such that a magnetic pole of the third magnetic member in the second direction faces a magnetic pole of the fourth magnetic member in the second direction, the magnetic poles being different from each other in polarity.

6. The printing apparatus according to claim 3, wherein the head holding member is configured such that the second engagement member, the second magnetic member, and the fourth magnetic member are positioned on a first side or a second side in the second direction, and the head holding member holds the thermal head such that the thermal head is removably held by the head holding member either on the first side or the second side in the second direction in accordance with a position of the second engagement member, the second magnetic member, and the fourth magnetic member.

7. The printing apparatus according to claim 3, wherein the head holding member is configured such that the second engagement member, the second magnetic member, and the fourth magnetic member are positioned on both a first side and a second side in the second direction, and the head holding member holds the thermal head such that the thermal head is removably held by the head holding member either on the first side or the second side in the second direction.

8. The printing apparatus according to claim 4, wherein each of the first magnetic member, the second magnetic member, the third magnetic member, and the fourth magnetic member is a permanent magnet, a first end and a second end of the second engagement member in the second direction have different shapes, the first end of the second engagement member as an engagement end is engaged with the first engagement member, the head holding member includes a holding part which holds the second engagement member such that the engagement end of the second engagement member is positioned on the first side or the second side in the second direction relative to the head holding member, magnetic poles of the second magnetic member and magnetic poles of the fourth magnetic member are ends in the second direction, and the second magnetic member and the fourth magnetic member are held by the head holding member such that the ends of the second magnetic member and the ends of the fourth magnetic member are exposed from the head holding member, one of the magnetic poles of the second magnetic member on the first side in the second direction is different from one of the magnetic poles of the fourth magnetic member on the first side in the second direction in polarity, and a magnetic pole of the first magnetic member on a side facing the head holding member is different from a magnetic pole of the third magnetic member on the side facing the head holding member in polarity.

9. The printing apparatus according to claim 1, wherein the second engagement member is a shaft having the first axis, and the first engagement member has an engagement hole into which the shaft is removably inserted.

10. The printing apparatus according to claim 9, wherein the head holding member further includes a rolling member into which the shaft is inserted, the rolling member protruding beyond a surface of the head holding member on the first side in the third direction and configured to pivotally move around the first axis, and the head pressing member makes contact with the rolling member from the first side in the third direction.

11. The printing apparatus according to claim 10, wherein the rolling member protrudes beyond a surface of the head holding member on a second side in the third direction, and the thermal head has a curved surface positioned on the second side in the third direction relative to the head holding member in the case that the first engagement member is engaged with the second engagement member, the curved surface curves in the first direction depending on an outer circumference of the rolling member, and the curved surface is configured to receive the rolling member on the second side in the third direction.

12. The printing apparatus according to claim 10, wherein the heating elements are formed along an edge, of the thermal head, facing a second side in the third direction and extending in the first direction, and a virtual line intersecting a center of the rolling member in the second direction and a position of the heating elements in the second direction is parallel to the third direction.

13. The printing apparatus according to claim 3, wherein the second engagement member is a shaft having the first axis, the first engagement member has an engagement hole into which the shaft is removably inserted, and the sum of static frictional force between the first magnetic member and the second magnetic member and static frictional force between the third magnetic member and the fourth magnetic member with the first engagement member being engaged with the second engagement member is smaller than pressing force of the head pressing member.

14. The printing apparatus according to claim 3, wherein the sum of moment around the first axis due to static frictional force caused by magnetic force between the first magnetic member and the second magnetic member and moment around the first axis due to static frictional force caused by magnetic force between the third magnetic member and the fourth magnetic member is larger than moment around the first axis due to gravity and external force received by the thermal head.

15. The printing apparatus according to claim 14, further comprising a harness which is attached to the thermal head at a position separated from the first engagement member in the first direction, wherein the external force received by the thermal head includes pressing force from the harness.

16. A printing apparatus, comprising:

a base;

a thermal head including heating elements arranged in a front-rear direction;

a first engagement member provided in the thermal head;

a second engagement member facing the first engagement member in a left-right direction intersecting with the front-rear direction and configured to engage with the first engagement member such that the thermal head pivotally moves, relative to the base, around a first axis extending in the left-right direction;

a head holding member having the second engagement member, being slidable with respect to the base in an up-down direction intersecting with the front-rear direction and the left-right direction, and holding the thermal head such that the heating elements face downward;

a first magnetic member provided in the thermal head and positioned on a first side in the front-rear direction relative to the first engagement member;

a second magnetic member provided in the head holding member, positioned on the first side in the front-rear direction relative to the second engagement member, and facing the first magnetic member in the left-right direction so that the first magnetic member and the second magnetic member are attracted to each other by magnetic force, in a case that the first engagement member is engaged with the second engagement member; and a head pressing member supported by the base to pivotally move around a second axis extending in the left-right direction and configured to press the head holding member from above.

* * * * *